US005839032A

United States Patent [19]

Yasui et al.

[11] Patent Number: 5,839,032

[45] Date of Patent: Nov. 17, 1998

[54] IMAGE FORMING APPARATUS HAVING SELECTABLY CONTROLLED SHEET DISCHARGE PATHS

[75] Inventors: Motokazu Yasui; Masaaki Yoshikawa; Yasuhisa Katoh, all of Kanagawa, Japan

[73] Assignee: Ricoh Company, Ltd., Tokyo, Japan

[21] Appl. No.: 824,548

[22] Filed: Mar. 25, 1997

[30] Foreign Application Priority Data

| | | | |
|---|---|---|---|
| Mar. 8, 1996 | [JP] | Japan | 8-051903 |
| Oct. 30, 1996 | [JP] | Japan | 8-287780 |
| Jan. 22, 1997 | [JP] | Japan | 9-009754 |
| Jan. 22, 1997 | [JP] | Japan | 9-009755 |

[51] Int. Cl.[6] ..... G03G 15/00

[52] U.S. Cl. ..... 399/124; 271/184; 399/110; 399/364; 399/401

[58] Field of Search ..... 399/21, 107, 110, 399/124, 125, 364, 388, 397, 401, 405; 271/3.14, 278, 279, 301, 302, 184, 185

[56] References Cited

U.S. PATENT DOCUMENTS

| | | | |
|---|---|---|---|
| 5,255,061 | 10/1993 | Matsuura et al. | 399/124 |
| 5,280,331 | 1/1994 | Namiki | 399/124 |
| 5,418,606 | 5/1995 | Kikuchi et al. | 399/381 |
| 5,579,098 | 11/1996 | Noguchi et al. | 399/122 |
| 5,680,651 | 10/1997 | Tsuji et al. | 399/401 |

FOREIGN PATENT DOCUMENTS

| | | |
|---|---|---|
| 8-146689 | 6/1996 | Japan . |
| 8-188344 | 7/1996 | Japan . |
| 8-202095 | 8/1996 | Japan . |

*Primary Examiner*—Arthur T. Grimley
*Assistant Examiner*—Sophia S. Chen
*Attorney, Agent, or Firm*—McDermott, Will & Emery

[57] ABSTRACT

An image forming apparatus in which a sheet conveying path and a sheet discharging path are exposed when a side cover is opened for removing a jammed sheet. The side cover, together with attached copy exit guide plate for sheets is exchangeably and detachably mounted to the main body of the apparatus and serves commonly as a side cover for a simplex type copying machine and a duplex type copying machine. Separate units, attached to each other and aligned, establish sheet discharging paths to different destinations, for example, sheet discharging trays. Sheets are guided to the paths by a course selecting pick. One of the two units includes rollers for directing sheets to a mail box or duplex copying unit, selectably. Disclosed embodiments enable copy sheets to be delivered selectably to face up and face down discharging trays or selectably to mail box and face down discharging trays.

23 Claims, 15 Drawing Sheets

227
R1
230
U1
262
260
R
228
P
221a
222

227
2119
2137
U2
R2
230
R1
U1
262
260
R
228
P
221b
222

280
227
2119
U2
R2
230
R1
U1
260
R
228
P
221
222

IMAGE FORMING APPARATUS HAVING SELECTABLY CONTROLLED SHEET DISCHARGE PATHS

TECHNICAL FIELD

The present invention relates an image forming apparatus, such as an electrophotographic reproduction machine, a printer, a facsimile or the like, and more particularly to such an apparatus capable of operating in simplex and duplex copying modes. Manufacturing cost of the apparatus is reduced by sharing components in simplex and duplex copying modes, and ease of correcting paper jams is enhanced by improved exposure of sheet discharging sections for servicing.

BACKGROUND ART

Multifunctional image forming apparatus having the function of a reproduction machine, a printer, a facsimile or the like are increasing in popularity. When such an apparatus is used as a printer, a sheet reversing mechanism must be mounted on a peripheral device, attached to the apparatus, so that copy sheets are discharged in the order of page numbers since the apparatus is of a construction based on that of a reproduction machine. However, because of the rapid development of personal computers, the usual construction of the image forming apparatus has principally been adapted for printers.

An image forming apparatus based on the construction of a reproduction machine includes an optical element layout that requires a long sheet conveying path due to the conventional horizontal orientation of the conveying path that converges with the optical element layout of the apparatus. Accordingly, a so-called vertical sheet conveying path system has been proposed in which a sheet is conveyed vertically from a sheet feeding unit located in the lower portion of an apparatus, passing through an image forming unit located in an upper part of the sheet feeding unit, and a sheet discharging section located in the uppermost part of the apparatus. Accordingly, the sheet on which a developed image is formed is discharged on the upper surface of the apparatus.

This type of system has an extremely short sheet conveying path in comparison with a conventional reproduction machine. Hence, sheet output time, that is, the interval time from the start of sheet feeding to the end of sheet discharging can be reduced, and the ease with which the sheet is conveyed improved. Furthermore, because the conveying path can be aptly exposed by opening a side cover of the apparatus, this type of apparatus is advantageous in that jammed sheets can easily be removed.

However, since the sheet discharging path at the back of an image fixing unit of the apparatus cannot be exposed, the above mentioned type of apparatus has a problem. When a sheet jam occurs at the sheet discharging section after a developed image has been fixed on the sheet, a long time is required for removal of the jammed sheet because there is no space for convenient access to the sheet. Further, when a duplex copying unit, which copies both sides of a sheet, is mounted on a vertical sheet conveying path system, there are two additional problems in the sheet discharging section of the apparatus.

1. In the vertical sheet conveying path system, the duplex copy unit has to be mounted outside the side cover of the apparatus to be exposed for removing a jammed sheet. This is because the amount of work required to remove the jammed sheet is more difficult. That is, two sheet paths are needed in the sheet discharging section of the duplex copying machine, one a normal discharging path and another a return conveying path for duplex copying. Since the normal discharging path is located at an inner part of the conveying path for duplex copying, a jammed sheet is not easily removed from the sheet discharging section even if the cover is opened for that purpose.

2. If, to improve the ease of removing a jammed sheet, the sheet discharging sections are made individually for the image forming apparatus of a simplex type copying machine (single sided copying) and a duplex type copying machine (both sides of the sheet are copied), the rate of production of such image forming apparatus tends to decrease and production costs correspondingly increase. On the other hand, if the sheet discharging section of a duplex type copying machine is used for simplex and duplex copying machines, the production costs of the simplex type copying machine will increase because the simplex machine now will have a multiplicity of unnecessary parts.

Therefore, to solve the above problems and others, an improved construction of an image forming apparatus is proposed herein not only for providing eased removal of jammed sheets but also reducing production costs for such apparatus.

DISCLOSURE OF THE INVENTION

In accordance with one aspect of the invention, an image forming apparatus comprises an image forming unit that transfers an image from an image carrying element and fixes the element on a sheet, a sheet feeding unit for feeding the sheet vertically to the image forming unit, and a sheet discharging section. A side cover of the apparatus is openable to expose the conveying path of the sheet, and mounted outside the side cover is a duplex copying unit for reversing the sheet. A course selecting member guides the sheet selectively toward a discharging tray or the duplex copying unit where an image is formed on the sheet, then the sheet is discharged toward the tray. The side cover is provided with a duplex copy exit guide plate for guiding the sheet discharged from the fixing unit toward the duplex copying unit for conveying the sheet from the sheet discharging section toward the duplex copying unit. The side cover, when opened, exposes the discharging path of the sheet within the sheet discharging section, while the duplex copying unit is moved away from (e.g., pivoted on) the side cover.

As another aspect of the invention, an image forming apparatus comprises an image forming unit, a sheet feeding unit for feeding sheets toward the image forming unit and a sheet discharging section for discharging sheets to a tray. A side cover of the apparatus is openable for exposing a vertical conveying path for the sheets to the image forming unit. A duplex copying unit for reversing sheets is detachably mounted to the apparatus at the side cover. A simplex copy exit guide plate guides sheets discharged by the fixing unit toward the discharging tray, and a duplex copy exit guide plate guides the discharged sheets toward the duplex copying unit. The simplex and duplex copy exit guide plates are mounted exchangeably and detachably on the side cover. When the duplex copying unit is not mounted, the simplex copy exit guide plate is mounted to the side cover, and when the side cover is opened to expose the conveying path, the discharge path is also exposed. On the other hand, when the duplex copying unit is mounted, a course selecting member, which may be in the form of a selecting pick, is mounted on a sheet discharging guide plate. The pick selectively guides the sheet from the fixing unit toward the discharging tray or the duplex copying unit, the duplex copy exit guide plate and relay rollers for conveying the sheet from the sheet discharging section to a duplex copying unit mounted on the side cover. The duplex copy exit guide plate and relay rollers expose the discharging path of sheets at the sheet discharging section when the conveying path is exposed by the side cover while the duplex copying unit is separated from the side cover.

In accordance with another aspect of the invention, an image forming apparatus comprises an image forming unit, a sheet feeding unit for feeding sheets from a stacker to the image forming unit and a sheet discharging section having a discharging tray located at an uppermost part of the image forming unit. A side cover is provided for exposing a sheet conveying path of the sheet while the sheet is being conveyed approximately vertically by the sheet feeding unit and discharging the sheet toward the discharging tray. A duplex copying unit for reversing the sheets is attachably mounted to a main body of the apparatus that is located outside the first cover. A discharging guide plate guides the sheet from the fixing unit toward the discharging tray and an exit guide plate is provided for guiding the sheet toward the duplex copying unit. A course selecting member mounted on a sheet discharging unit guides the sheet from the fixing unit selectively toward the discharging tray or the duplex copying unit. A course selecting member driving device, mounted detachably on the sheet discharging unit, drives the course selecting member for sheet selection. When the course selecting member driving device is detached from the sheet discharging unit, the course selecting member is in a state to guide the sheet toward the discharging tray. Hence, parts that are applied especially for duplex copying are detachably mounted to the apparatus, and other parts are commonly applied for both simplex and duplex copying, thereby reducing parts cost.

BRIEF DESCRIPTION OF THE DRAWINGS

A more complete appreciation of the invention will become better understood by reference to the following detailed description when considered in connection with the accompanying drawings, wherein.

BEST MODE FOR CARRYING OUT THE INVENTION

First Embodiment

The present invention will now be described in detail with respect to the accompanying drawings.

Figure 1:
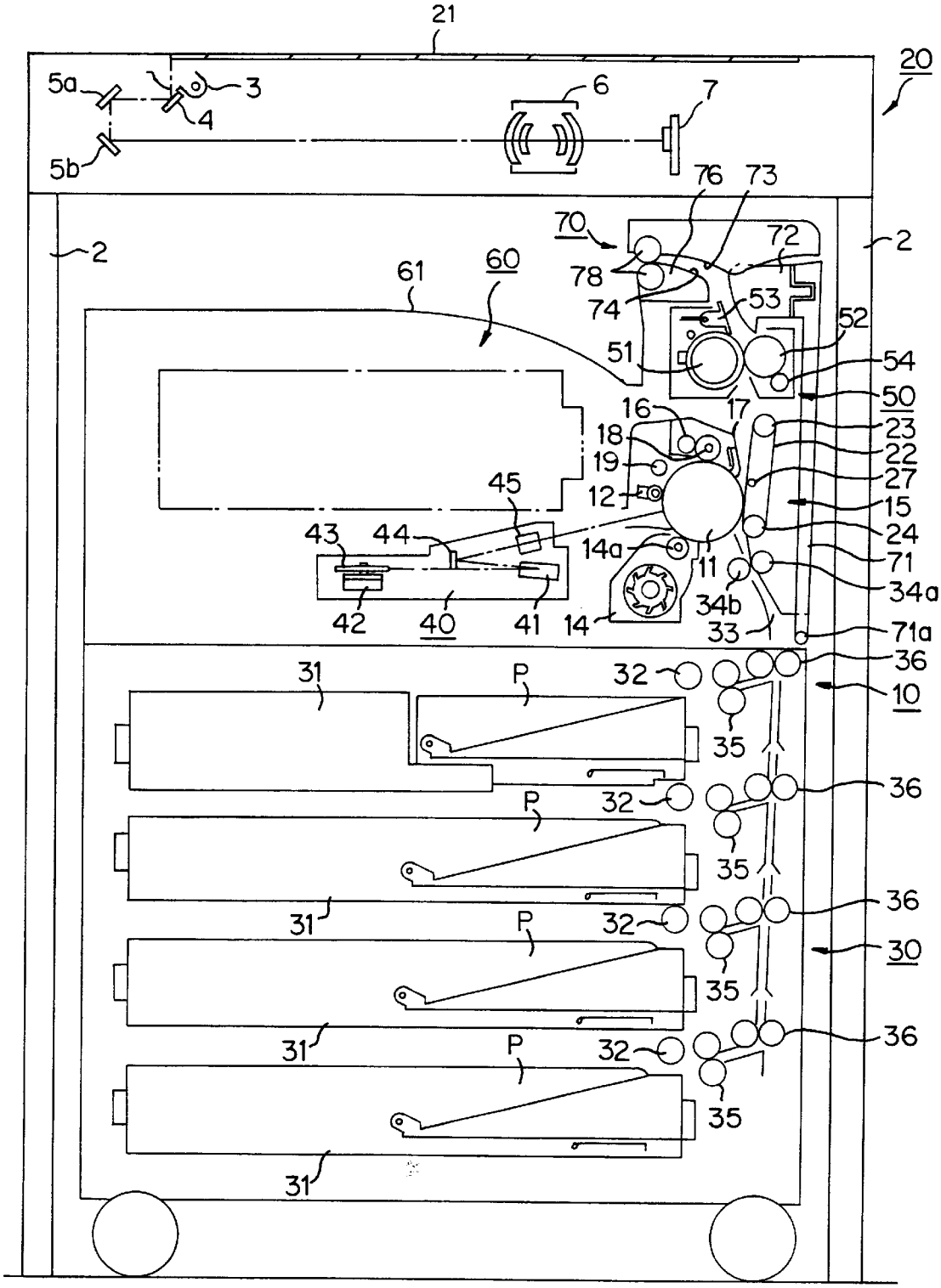
FIG. 1 is a schematic illustration of an image forming apparatus showing an embodiment of the present invention.

In FIG. 1, numeral 10 denotes an image forming apparatus and numeral 20 denotes a scanner which reads image information from a document and is built in a different body or chassis from the image forming apparatus 10.

The image forming apparatus 10 includes an image forming unit 60 for forming an image, a sheet feeding unit 30 which is connected to the image forming unit 60 for feeding a sheet P towards the image forming unit 60, and a sheet discharging section 70 disposed at an upper part of the image forming unit 60 for discharging and stacking the sheet P on which the image is formed.

Figure 2:
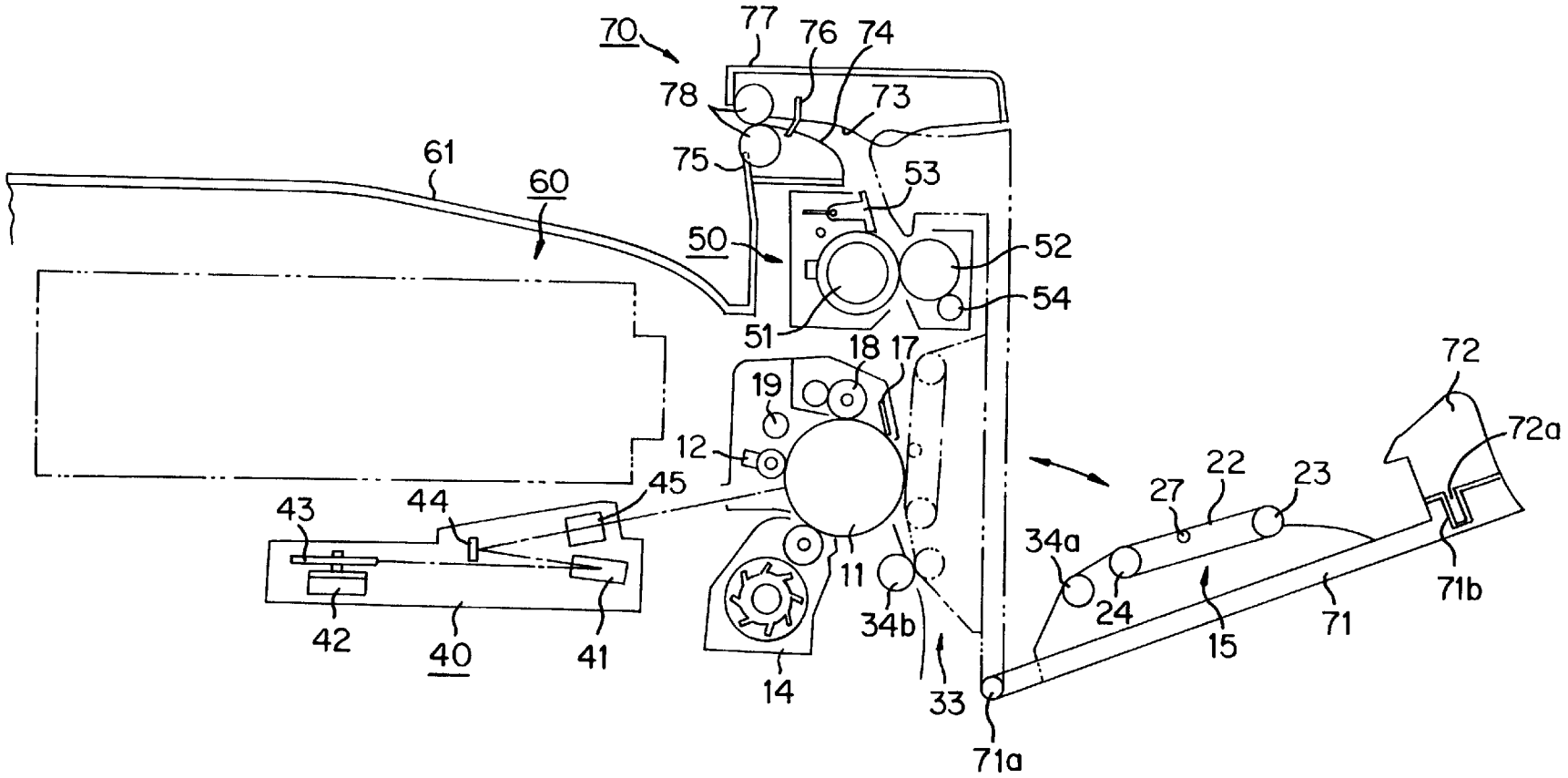
FIG. 2 is an enlarged schematic illustration showing a sheet discharging section and an image forming unit in the image forming apparatus of FIG. 1.

Referring also to FIG. 2, the image forming apparatus 60 is provided with a photoconductive element 11 as an image carrying element, an optical image writing unit 40 for forming an electrostatic latent image, a charging device 12 for uniformly charging the surface of the photoconductive element 11, an eraser (not shown) for erasing charge in non-image areas of the photoconductive element 11, a developing unit 14 for developing the electrostatic latent image into a visible image, a transfer unit 15 for transferring the visible image developed by the developing unit 14 onto the sheet P and for conveying the sheet P, a fixing unit 50 for melting and fixing the toner image which is transferred by the transfer unit 15, a cleaning unit 16 for cleaning the photoconductive element 11 by removing remaining toner on the photoconductive element 11 after the image transfer, and a discharging unit 19 for discharging residual charge on the photoconductive element 11 following the image transfer. In addition, numeral 80 denotes a toner bottle for storing toner to be provided to the developing unit 14.

The optical image writing unit 40 is a unit which converts image data sent by the scanner 20 into optical signals and optically writes an image corresponding to an original image on the photoconductive element 11, and optically writes an image according to image information from personal computers. The optical image writing unit 40 irradiates a laser beam onto the photoconductive element 11, which beam is sent by a laser beam source 41 via a polygon mirror 43 rotated by a drive motor 42, a reflector 44, and a fθ (f-theta) lens 45, so that a latent image is formed on the photoconductive element 11.

The cleaning unit 16 includes a blade 17 which contacts the photoconductive element 11, and a brush 18 located downstream on the photoconductive element 11 from the contact point of the blade 17 and the photoconductive element.

A transfer belt 22 of the transfer unit 15 is disposed to contact the photoconductive element 11, and the transfer belt 22 is passed around a drive roller 23 and a driven roller 24. The transfer belt 22 is made of rubber material which has a medium electric resistance whose change with environmental changes, etc., is relatively small. A surface of the transfer belt 22 is applied with a coating material having a relatively low coefficient of friction.

At a place on an internal periphery of the transfer belt 22 at a predetermined distance from a nip between the photoconductive element 11 and the transfer belt 22 towards the drive roller 23, a bias roller 27 which applies a bias-voltage to the transfer belt 22 is disposed in contact with an internal surface of the transfer belt 22. "Nip" means a contacting area of a roller with any other thing such as a roller, a belt or the like. The bias roller 27 is a metal roller and is connected to a high voltage power source (not shown) which is driven by rotation of the transfer belt 22 and applies the bias-voltage to the photoconductive element 11.

The fixing unit 50 includes a pair of fixing rollers 51 and 52, a cleaning roller 54 contacting the fixing roller 52, and separating picks 53 disposed to be in contact with the fixing roller 51.

The sheet feeding unit 30 includes a plurality of feeding cassettes 31. The sheet feeding unit 30 feeds the sheet P by a feeding roller 32 from one of the feeding cassettes 31, separating the sheet P individually by a pair of separation rollers 35, and conveys out the sheet P to a conveying path 33 by a conveying roller 36. Registration rollers 34*a* and 34*b* are disposed on the conveying path 33 and before the transfer unit 15 and feed the sheet P with a predetermined timing, towards the nip between the transfer unit 15 and the photoconductive element 11.

The sheet discharging section 70 includes a simplex copy exit guide plate 72 (one of two types of exit guide plate in this invention) for guiding the sheet P from the fixing unit 50 towards a discharging tray 61, an upper discharging guide plate 73, a lower discharging guide plate 74, a discharging frame 75 for supporting the lower discharging guide plate 74, and a pair of discharging rollers 78 for conveying the sheet P towards the discharging tray 61. Numeral 76 denotes a sheet discharging sensor for detecting a passing sheet P. The lower discharging guide plate 74 is constructed in a body commonly with the discharging frame 75, and the upper discharging guide plate 73 is constructed in a body commonly with an external cover 77 of a main body, each of which is detachably mounted on the main body.

To expose the conveying path 33 of the sheet P for removing a sheet P when sheet jamming has occurred, a side cover 71 is provided at a side face of the image forming unit 60 for swinging open and closed relative to the main body about a shaft 71*a* in a direction indicated by an arrow shown in FIG. 2. A groove 71*b* to which an engaging projection 72*a* of a simplex copy exit guide plate 72 engages is formed at a free end of the side cover 71. The simplex copy exit guide plate 72 is detachably mounted on the side cover 71. When the side cover 71 moves from a position shown by imaginary line to a position shown by solid line in FIG. 2, the simplex copy exit guide plate 72 is also moved so that both the conveying path 33 and the discharging path of the sheet P at the back of the fixing unit 50 are exposed.

The scanner 20 is mounted on a rack 2, and is composed of a contacting glass 21 for mounting an original, an illumination lamp 3 for illuminating the original mounted on the contacting glass 21, a scanning mirror 4 for reflecting light from the original surface, a pair of light path turning mirrors 5*a* and 5*b* which move half the velocity of the scanning mirror 4, a focusing lens 6, and a CCD (Charge Coupled Device) 7.

Operation of the image forming apparatus based on above-mentioned construction is hereinafter described.

An image of an original read by the scanner 20 or an image from a personal computer is optically written on the photoconductive element 11 by the optical image writing unit 40, so that the latent image is formed on the surface of the photoconductive element 11 which has been uniformly charged by the charging device 12. Any charge on a non-image part of the latent image on the photoconductive element 11 is removed by an eraser. The latent image on the photoconductive element 11 is developed with toner by a developing roller 14*a* wherein the toner is charged by the developing unit 14 and is attracted to the developing roller 14*a*.

The sheet P is fed from one of the feeding cassettes 31 in the sheet feeding unit 30 by the feeding roller 32, being separated individually by the separation rollers 35, and is conveyed along a path 33 by the conveying roller 36. The sheet P is further conveyed to the registration rollers 34*a* and 34*b*. The registration rollers 34*a* and 34*b* convey the sheet P towards the transfer unit 15 at a timing so that the visual image on the photoconductive element 11 is exactly transferred to the predetermined position of the sheet P at the nip of the photoconductive element 11 and the transfer belt 22.

In agreement with the timing at which the sheet P enters into the nip of the photoconductive element 11 and transfer belt 22, a predetermined voltage is applied to the bias roller 27 from the high voltage power source which charges the transfer belt 22, and transfers toner on the photoconductive element 11 to the sheet P. On this occasion, since the sheet P is attracted to the transfer belt 22 electrostatically, the sheet P is separated from the photoconductive element 11, and is conveyed by the transfer belt 22. The sheet P is separated from the transfer belt 22 at a position of the drive roller 23 by curvature separation and conveyed towards the fixing unit 50. (Curvature separation means that when a rotating belt is passed around a pair of rollers, a flat sheet of paper conveyed by the rotating belt can be separated from the belt at the curved position.)

The sheet P having the toner image is inserted between the pair of fixing rollers 51 and 52 which are heated to a predetermined temperature to heat and fix the toner image. The sheet having the fixed toner image is then guided by the simplex copy exit guide plate 72, passing between the upper discharging guide plate 73 and lower discharging guide plate 74 and discharging towards the discharging tray 61 by a pair of discharging rollers 78.

Toner remaining on the photoconductive element 11 is removed by the blade 17 and the brush 18 of the cleaning unit 16. Any remaining charge on the photoconductive element 11 is removed by the discharging unit 19 to make preparations for the next image forming procedure.

If the sheet P jams in the main body, both the conveying path 33 and the discharging path of the sheet P at the back of the fixing unit 50 are exposed by an operator who manually moves the side cover 71 from a position shown by imaginary line to a position shown by solid line in FIG. 2, so that a space for removing the jammed sheet is made available. The jammed sheet P then can be easily removed from the exposed paths.

Figure 3:
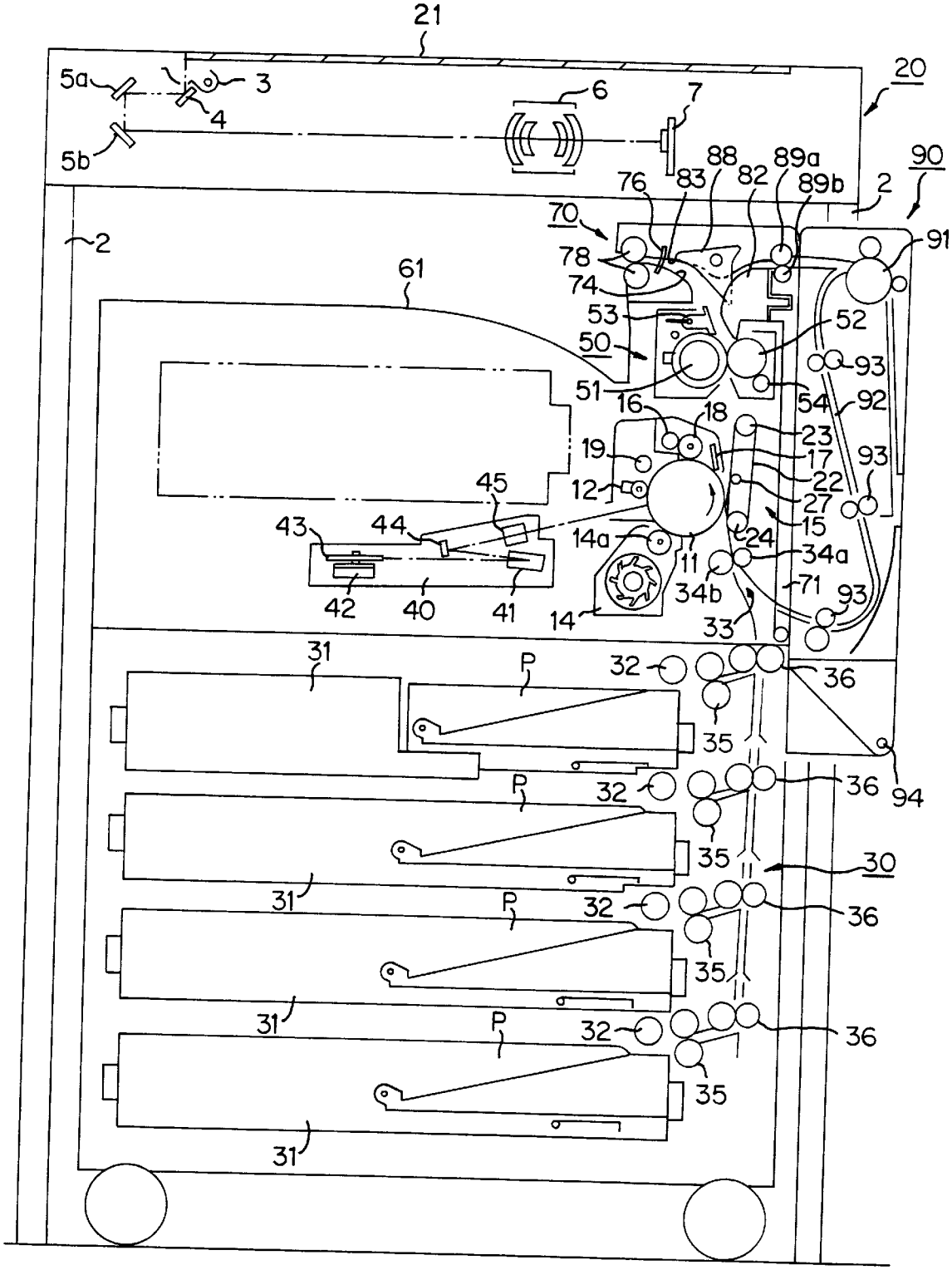
FIG. 3 is a schematic illustration of an image forming apparatus for explaining an aspect of the invention.
Figure 4:
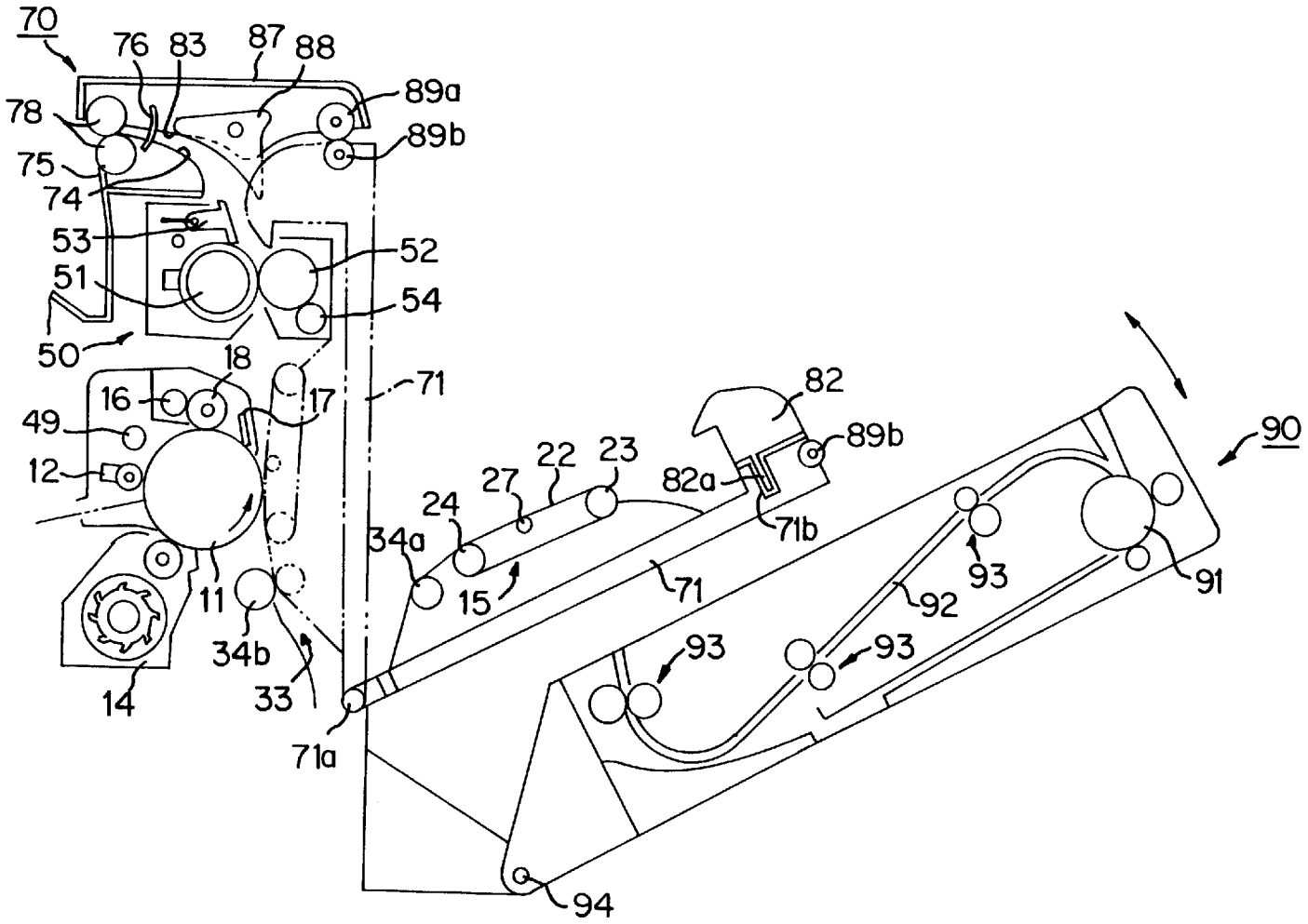
FIG. 4 is an enlarged schematic illustration of a sheet discharging section and an image forming unit of the image forming apparatus of FIG. 3.

A variation of this embodiment of the invention is shown in FIGS. 3 and 4. The image forming apparatus in this embodiment has an additional function which is duplex image formation, that is, copying is performed on both sides of the sheet P. The constructional differences between the aforementioned embodiment and this embodiment are as follows. The apparatus includes a duplex copying unit 90 which reverses the sheet P fed by the fixing unit 50, a course selecting member or selecting pick 88 which selectably guides the sheet P fed by the fixing unit 50 towards the discharging tray 61 or the duplex copying unit 90, relay rollers 89*a* and 89*b* which convey the sheet P from the sheet discharging section 70 towards the duplex copying unit 90, and a duplex copy exit guide plate 82 (the second of two types of exit guide plate in the invention) for guiding the sheet P towards the discharging tray 61 or the duplex copying unit 90. The apparatus further is provided with an external cover 87 instead of an external cover 77 constructed in a body commonly with an upper sheet discharging guide plate 83.

The duplex copying unit 90 is disposed outside the side cover 71, being detachably mounted to the apparatus, and is held for swinging open and closed relative to the apparatus about a shaft 94 as shown in FIG. 4. The duplex copying unit 90 includes a reversing roller 91 which receives the sheet P conveyed from relay rollers 89*a* and 89*b* and reverses the sheet P, and pairs of conveying rollers 93 for conveying the reversed sheet P towards a pair of the registration rollers 34*a* and 34*b* through a duplex path 92.

Each of the selecting pick 88 and the relay roller 89*a* is held detachably in the upper sheet discharging guide plate 83 respectively. In the case of duplex copying, the selecting pick 88 is selectably changed in operation by a device (not shown) to a position in which the sheet P is guided to the discharging tray 61 or the position in which the sheet P is guided to the duplex copying unit 90.

The relay roller 89*b* is held for rotation at a free end of the side cover 71, including the groove 71*b* which is engaged with an engaging projection 82*a* of the duplex copy exit guide plate 82 so that the duplex copy guide plate 82 is detachably mounted to the side cover 71. The engaging projection 82*a* of the duplex copy exit guide plate 82 and the engaging projection 72*a* of the simplex copy exit guide plate 72 in the aforementioned embodiment have the same shape. Therefore, the duplex copy exit guide plate 82 and the simplex copy exit guide plate 72, both of which are detachably mounted to the side cover 71, are exchangeable with each other. By adapting this construction, the side cover 71 is used commonly for both a duplex type and a simplex type of the image forming apparatus, and manufacturing cost is reduced.

On this basis, if the side cover 71 is moved from the position indicated by imaginary line in FIG. 4 towards a position indicated by solid line, while the duplex copying unit 90 is pivoted away or separated from the side cover 71, both the duplex copy exit guide plate 82 and the relay roller 89*b* also move in conjunction with the side cover 71; not only the conveying path 33 of the sheet P but also the discharging path of the sheet P at the back of the fixing unit 50 is thus exposed.

In duplex copying, when an image is formed on the rear side of a sheet after forming an image on the top side of the sheet P using the same process as the aforementioned embodiment, the sheet P is guided along the duplex copy exit guide plate 82 by the selecting pick 88 and conveyed towards the duplex copying unit 90 by the relay rollers 89*a* and 89*b*. Then the sheet P is switched back into the duplex copying unit 90, being passed through the duplex path 92, and is conveyed again towards a pair of the registration rollers 34*a* and 34*b*. Then, by repeating the same image forming process as mentioned before, the sheet P is stacked on the discharging tray 61.

When jamming of the sheet P occurs, if the side cover 71 is moved from the position indicated by imaginary line in FIG. 4 to the position indicated by solid line, the relay roller 89*b* and the duplex copy exit guide plate 82 move with the side cover 71 so that the conveying path 33 and the discharging path at the back of the fixing unit 50 are exposed. Therefore, space for removing the jammed sheet is secured and the jammed sheet P can be easily removed from the opened space.

Second Embodiment

A sheet discharging unit in accordance with a second embodiment of the present invention is explained below based upon FIGS. 5 through 14.

Figure 5:
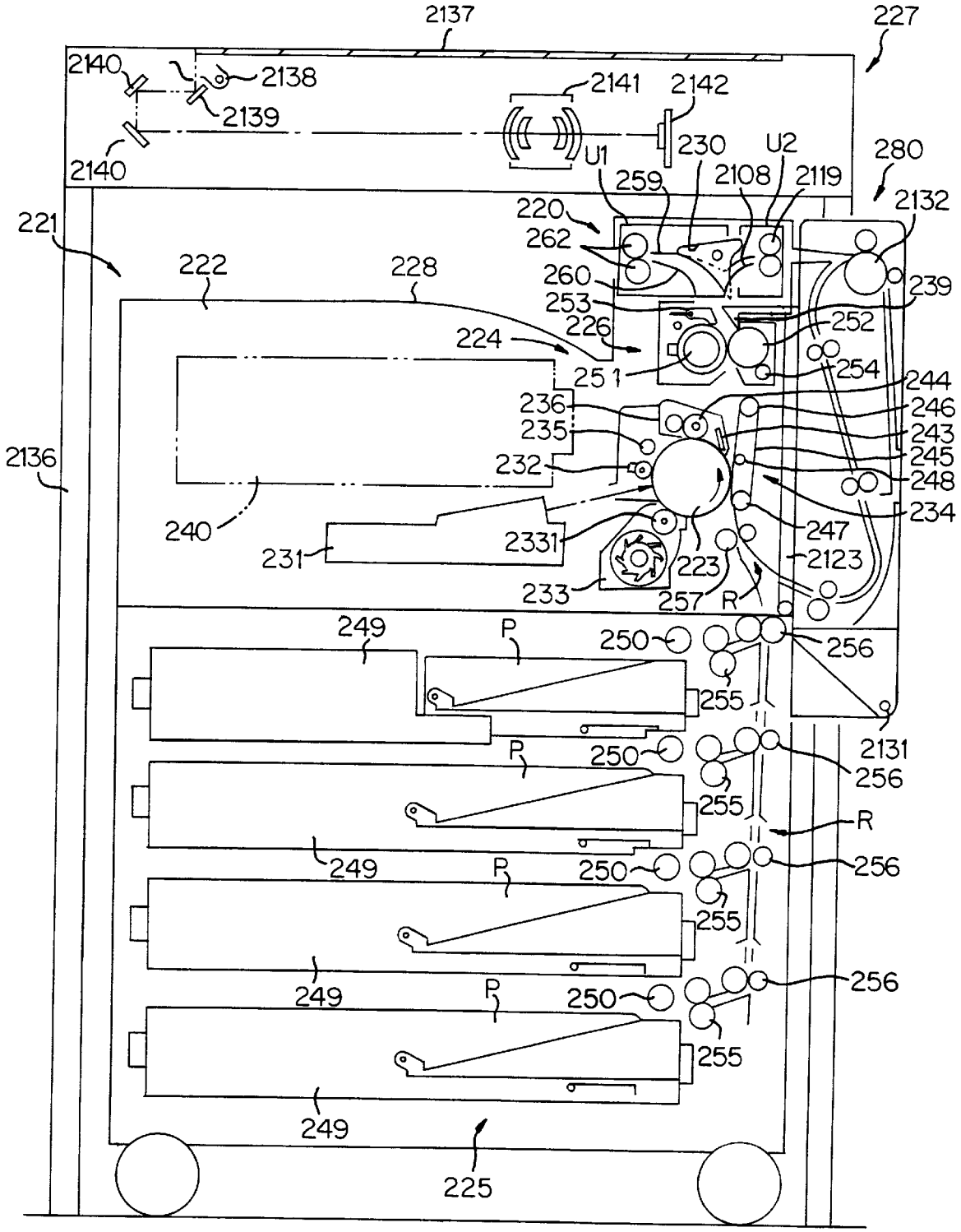
FIG. 5 is an illustration showing a schematic construction of an image forming apparatus having a sheet discharging unit in accordance with another embodiment of the present invention.

A sheet discharging unit 220 in FIG. 5 is mounted on an image forming apparatus 221. The image forming apparatus 221 is provided with an image forming unit 224 in the center thereof having a photoconductive element 223 or the like in the internal unit, a sheet feeding unit 225 which is located beneath thereof, a fixing unit 226 and the sheet discharging unit 220 as a sheet discharging part in an upper part thereof. Furthermore, an image reading part (hereinafter called "scanner") 227 is above the sheet discharging unit 220, and the apparatus is provided with duplex copying by locating a duplex copying unit 280 by the side of the main body 222. Still further, the main body 222 is located by the side of the sheet discharging unit 220, and an upper face part 228, serving as a face-down sheet discharging tray, is located just under the scanner 227.

FIG. 5 also shows the image forming apparatus 224 which includes the photoconductive element 223 as an image carrier, an optical writing device 231 which forms an electrostatic latent image on the photoconductive element 223, a charging device 232 which charges the photoconductive element 223 uniformly, and a developing device 233 which develops the latent image into a visual image. Further shown are a transferring unit 234 which transfers the visual image developed by the developing device 233 into a sheet P and conveys the sheet P towards the succeeding part, the fixing unit 226 which fixes the toner image transferred by the transferring unit 234, a cleaning unit 236 which cleans the photoconductive element 223 by removing the toner remained on the after transferred photoconductive element 223, and a discharging device 235 for removing charge which remains on the after transferred photoconductive element 223. Furthermore, 240 indicates a toner bottle for supplying toner towards the developing device 233.

The optical writing device 231 is a unit for converting image data from the scanner 227 to an optical signal and for executing optical writing corresponding to an original image and corresponding to image information from a personal computer (not shown). The device 231 has a well-known construction, that of scanning a laser beam via a polygon mirror, leading scanning-light by a fθ lens towards the photoconductive element 223, and forming an electrostatic latent image. The cleaning unit 236 is provided with a blade 243 which contacts the photoconductive element 223 and a brush 244 located at the lower stream of the rotating direction of the photoconductive element 223 of the blade 243.

A transferring belt 245 of the transferring unit 234 is contacting the photoconductive element 223, and the transferring belt 245 is movably positioned by a drive roller 246 and a driven roller 247. The belt 245 has a medium electric resistance and is made of rubber material whose change of electric resistance with environmental changes is relatively small. The surface of the transferring belt 245 is made of a coating member whose friction coefficient is small.

A bias roller 248 applies a bias voltage to transfer belt 245. The bias roller 248 is a metal roller which rotates, driven by rotation of the transfer belt 245, and is connected to a high voltage power source (not shown) which develops the bias voltage.

The fixing unit 226 includes a pair of fixing rollers 251 and 252, a cleaning roller 254 which contacts the fixing roller 252, and a selecting pick 253 contacting the fixing roller 251.

The sheet feeding part 225 has a plurality of feeding cassettes 249 containing the sheets P of different sizes respectively, and feeds one sheet from one of the cassettes 249 by a feeding roller 250, separating the sheets P individually by a pair of separating rollers 255, and sending it out along a conveying path by a conveying roller 256. A pair of registration rollers 257 for sending out the sheet P between the transferring unit 234 and the photoconductive element 223 at a predetermined timing is located in front of the transferring unit 234 on the conveying path R.

The sheet discharging unit 220, as a sheet discharging part, includes a first conveying path R1 for face-down discharging and a second conveying path R2 for conveying the sheet P towards the duplex copying unit 280. The unit 220 conveys the sheet P from the fixing part 226 in the main body selecting the sheet P by the selecting pick 230 towards the first conveying path R1 or the second conveying path R2 selectably. Significantly, the sheet discharging unit 220 is formed of a first unit U1 in the first conveying path R1 and a second unit U2 in the second conveying path R2, contained within two separate bodies.

Figure 10:
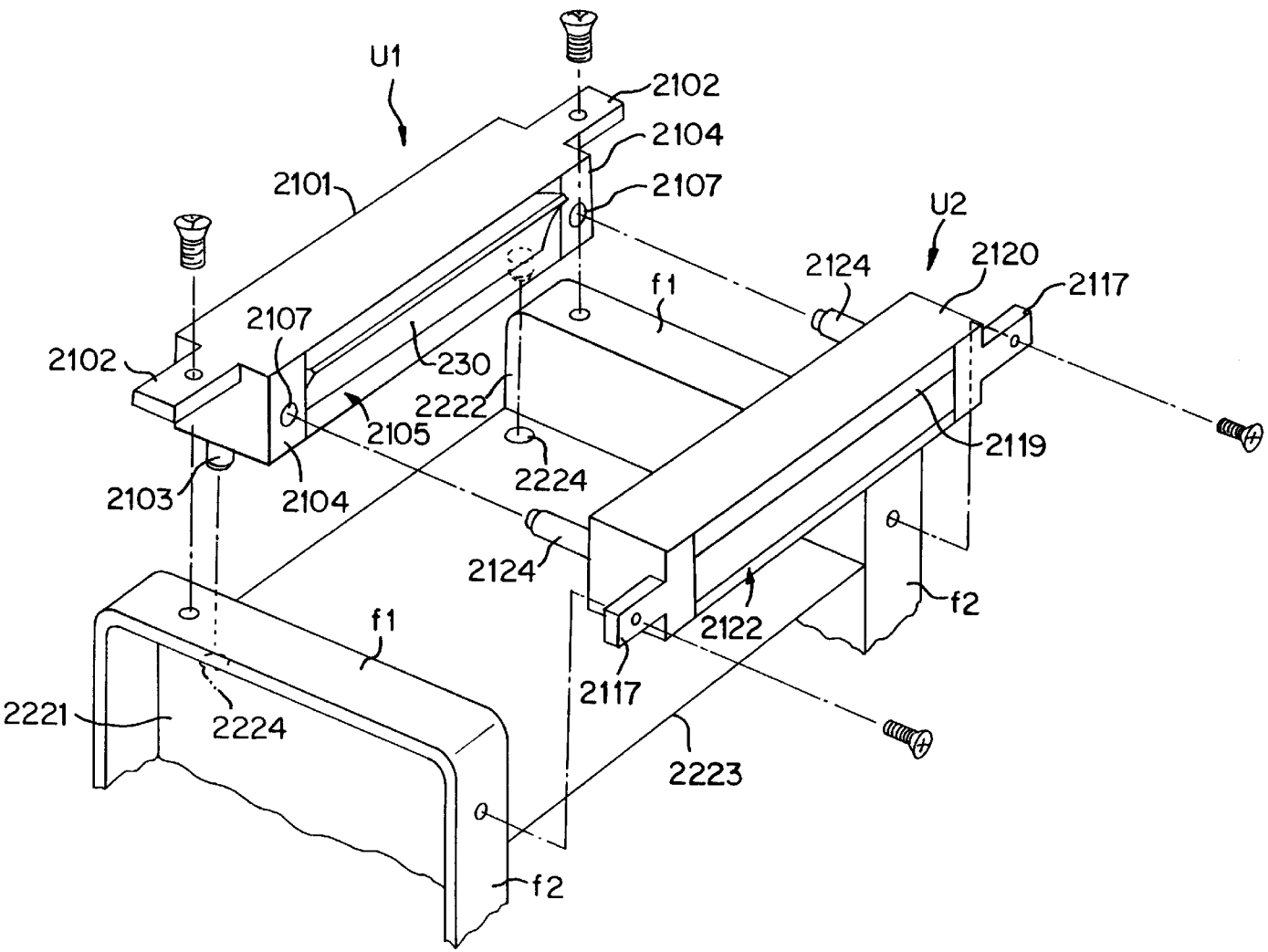
FIG. 10 is a perspective view of a sheet discharging unit and peripheral parts thereof, as shown in FIG. 5.
Figure 13:
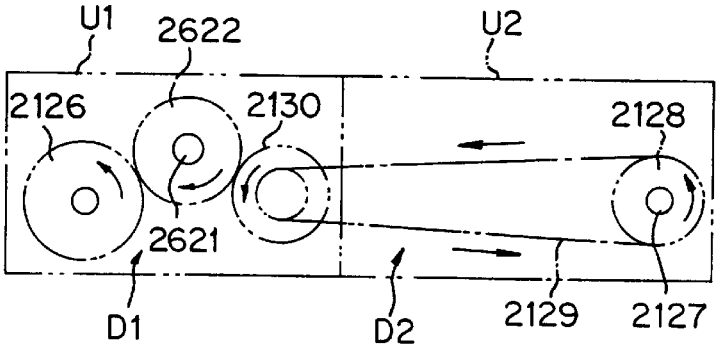
FIG. 13 shows a rotating drive layout mounted on the sheet discharging unit depicted in FIG. 5.

The first unit U1 has a long, box-like casing 2101, upper and lower sheet discharging guide plates 259 and 260 as a first guide plate disposed in an internal part, a pair of sheet discharging rollers 262 for sending out the sheet P towards the upper face part 228 as a sheet discharging tray for face-down sheet discharging, the selecting pick 230 for directing the sheet P selectably towards the first and second conveying path R1 and R2, a first drive transmission unit D1 (described later), and an idler 2130 as shown in FIG. 10 and FIG. 13.

Front and rear upper-connecting pieces 2102 are fixed to upper flanges f1 of front and rear bases 2221 and 2222 of the main body 222 by screws, extending the pieces 2102 respectively from side walls of front and rear ends of the casing 2101 (FIG. 10).

Furthermore, a pair of front and rear lower pins 2103 extend from the lower wall of the casing 2101, and the lower pins pierce through holes 2224 of a central plate 2223 of the main body 222. As a result, the casing 2101 is positioned exactly and gaps thereof are eliminated. Openings 2105 and 2106 are formed at the right-side and left-side parts of the casing 2101. Positioning pieces 2104 are disposed at the front and rear ends of the opening 2105, and a part of the separation pick 230 is inserted in a state of projecting outwards all over the opening 2105. An end part of the second unit U2 contacts the right and left positioning pieces 2104, and positioning holes 2107 are formed on the front and rear portions of the casing 2101 so that positioning pins 2124 of the second unit U2 fit thereof. Furthermore, the opening 2106 is formed of a size allowing to pass the sheet P conveyed from a pair of sheet discharging rollers 262 as the first sheet discharging rollers to the upper face part 228.

Figure 9:
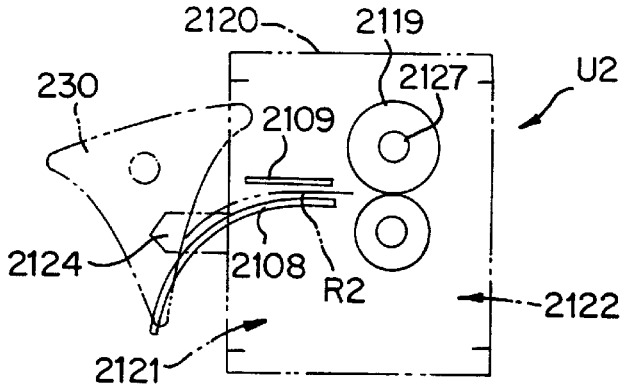
FIG. 9 shows the function of a second unit establishing a sheet discharging unit, as shown in FIG. 5.

The second unit U2 has a long, box-like casing 2120, upper and lower sheet discharging guide plates 2108 and 2109 as a second guide plate which is disposed in an internal part, a pair of duplex conveying relay rollers 2119 for sending the sheet P towards the duplex copying unit 280, and a second drive transmission unit D2 (described later) as shown in FIGS. 9 and 10.

The casing 2120 extends sideways, connecting pieces 2117 from a side wall of front and rear ends thereof respectively, and the front and the rear sideways connecting pieces 2117 are fixed to the sideways flanges f2 of the front and rear bases 2221 and 2222 of the main body by screws. Still further, openings 2121 and 2122 are formed at the right-side and left-side parts of the casing 2120. Positioning pieces (not shown) are mounted at front and rear end portions of the opening 2121, and the positioning pin 2124 is projected from the positioning pieces. The pins 2124 are constructed for positioning the first unit U1 with the second unit U2 by fitting into the positioning holes 2107 (FIG. 10) at the first unit U1. In the manner as stated above, relative positioning accuracy between the selecting pick 230 at the side of the first unit U1 and the lower sheet discharging guide plate 2108 at the side of the second unit U2 is secured (FIGS. 7 and 9), because when the first unit U1 and the second unit U2 are assembled, the positioning relative to each other is exactly done and the second conveying path R2 is accurately formed.

Furthermore, a tip end portion of the lower sheet guide plate 2108 projects from the opening 2121 (FIG. 9), and the tip end portion is formed insertably towards the opening 2105 of the first unit U1. The configuration of the opening 2122 is secured so that a pair of duplex conveying relay rollers 2119 as a second conveying roller for sending the sheet P towards the duplex copying unit 280 can pass the sheet P.

Figure 6:
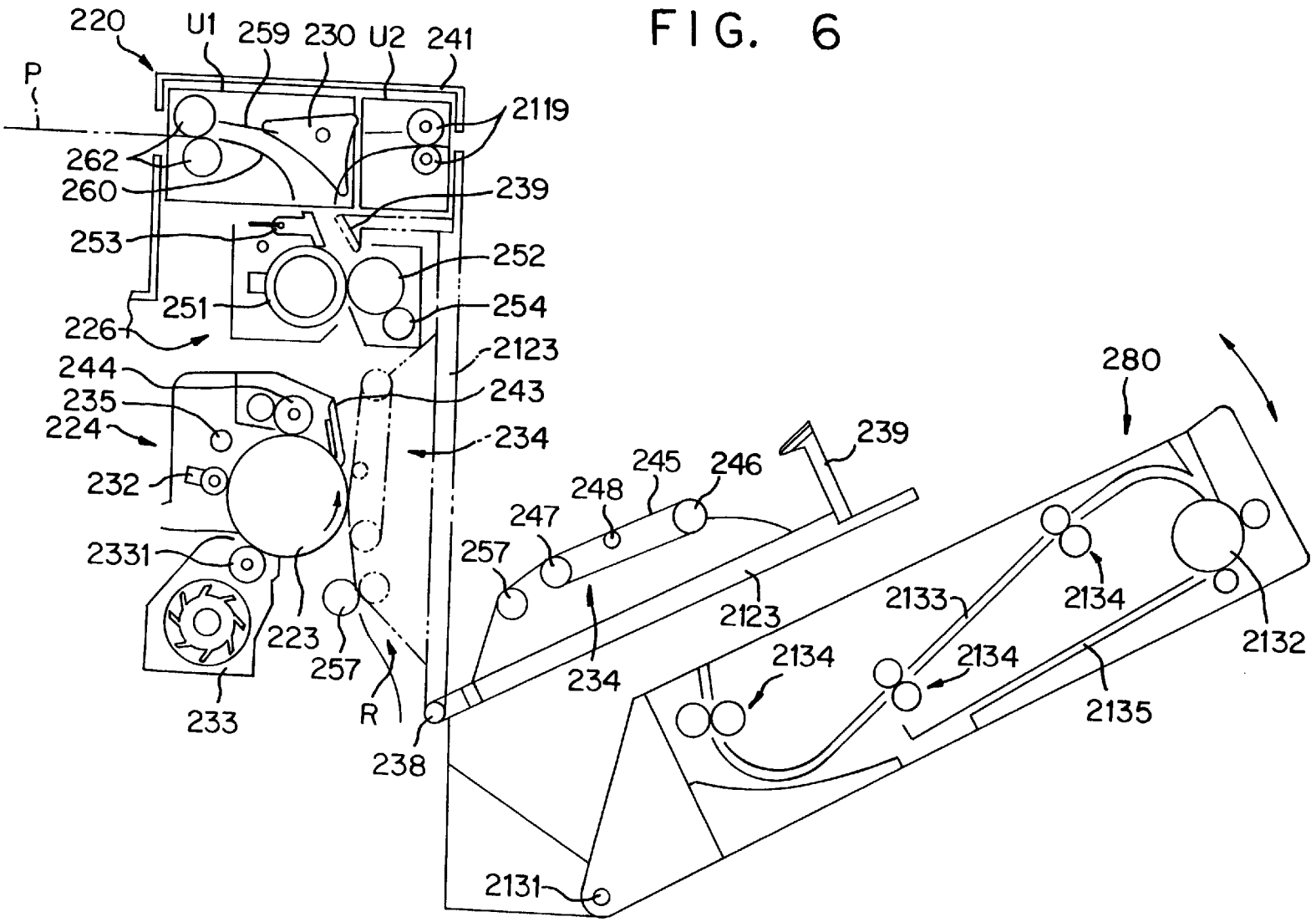
FIG. 6 is an illustration showing a partly enlarged construction of a sheet discharging unit and the peripheral parts thereof as shown in FIG. 5.
Figure 12:
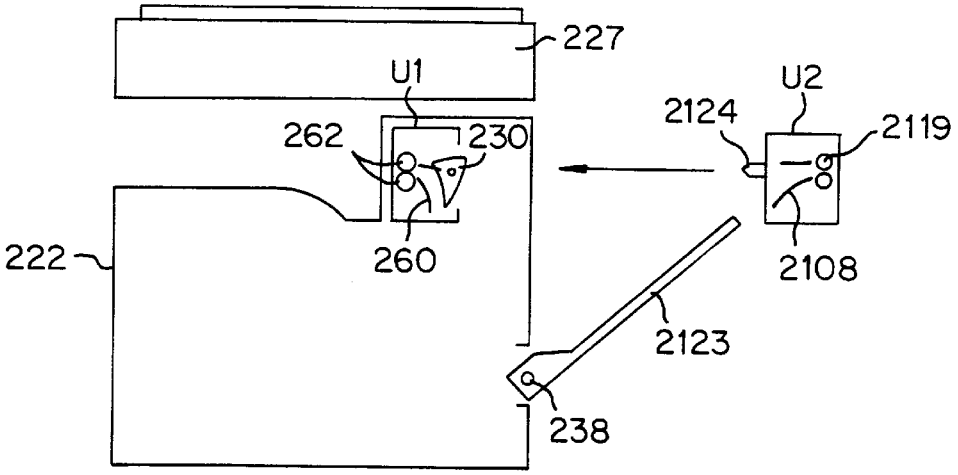
FIG. 12 helps explain the function of the side cover and second unit both mounted on an image forming apparatus as shown in FIG. 5.

Thus, the second unit U2 is positioned or mounted to the first unit U1 easily by fitting the positioning pin 2124 to the positioning hole 2107 at the first unit U1 and fixing the sideways connecting pieces 2117 to the sideways flanges f2 of the front and rear bases 2221 and 2222 by the screws. Furthermore, the second unit U2 is attached to or detached from the unit U1 easily when the duplex copying unit 280 and a side cover 2123 are opened as shown in FIGS. 6 and 12.

Figure 14:
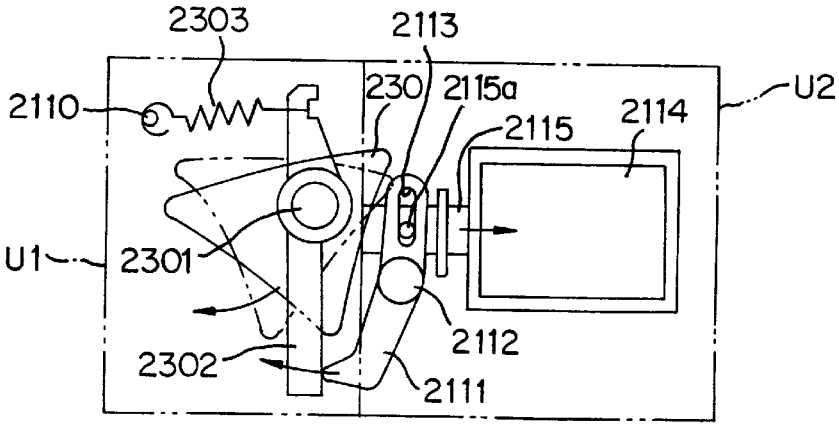
FIG. 14 is an enlarged side view showing a driving actuator for the selecting pick in the first unit which forms the sheet discharging unit shown in FIG. 5.

The separation pick 230 in the first unit U1 has a long, approximately triangular prism shape (FIG. 10) placed in a horizontal orientation, having a rotating shaft 2301 in a body longitudinally in a central part thereof. Right and left ends of the shaft 2301 are pivotably supported at a side wall of front and rear ends of the casing 2101. The lever 2108 is mounted in a body at a front side of the rotating shaft 2301, as shown in FIG. 14. An upper end portion of the lever 2302 is pulled in a counterclockwise direction by a spring 2303 hooked at a fixing pin 2110, and a lower end portion thereof is formed contactably with a drive lever 2111 of the second unit U2.

The second unit U2 supports a solenoid 2114 and a lever pin 2112 as operating parts for operating the selecting pick 230 towards an internal wall (not shown) of its casing 2120 respectively as shown in FIG. 14. The lever pin 2112 pivotably supports a central part of the drive lever 2111. A long hole 2113 is formed at an upper end of the drive lever 2111, and a pin 2115*a* of a movable iron core 2115 of the solenoid 2114 is inserted in the long hole 2113. A lower end portion of the drive lever 2111 is disposed contactably with the lever 2302 of the first unit U1 when the first unit U1 is connected to the second unit U2.

When the solenoid is in a non-magnetized state, the movable iron core is held in a projecting state, and a rotating end of a lower portion of the drive lever 2111 which is connected thereto separates from the lever 2302. The selecting pick 230 is held in a first position by the pulling force of the spring 2303 in a counterclockwise direction, as shown by solid line in FIG. 14. In this case, the selecting pick 230 forms an upper stream part of the first conveying path R1 together with the lower sheet discharging guide plate 260 as shown by solid line in FIG. 7. Furthermore, a lower stream part of the first conveying guide plate R1 is formed of the upper and lower sheet discharging guide plates 259 and 260.

Figure 7:
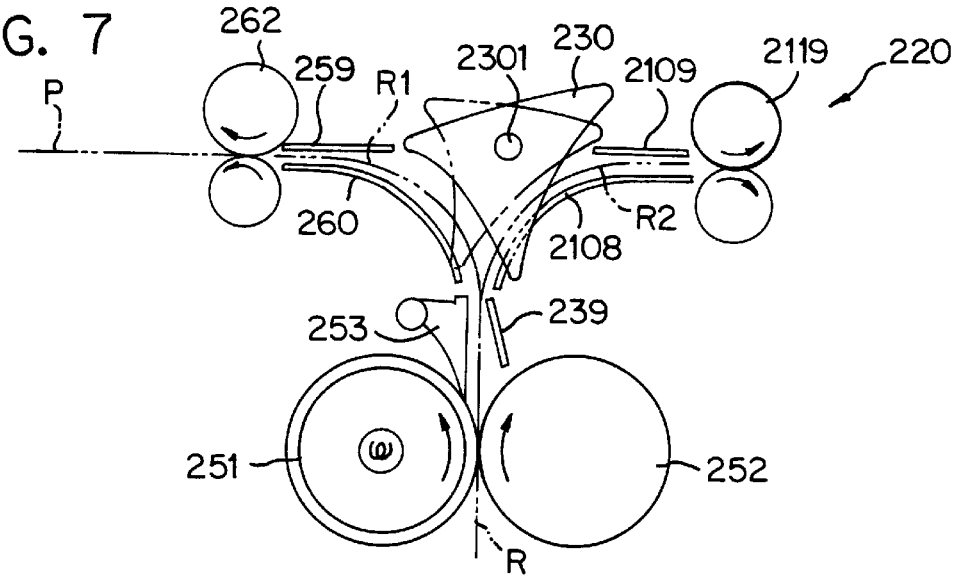
FIG. 7 helps explain the selecting pick, and the first and second paths, as depicted in FIG. 5.

On the contrary, when the solenoid 2114 is magnetized, the movable iron core 2115 pulls an upper part of the drive lever 2111, the lever 2302 is rotated in a clockwise direction, and the selecting pick 230 is held in a second position as indicated in two-dots-and-a-dash line. In this case, the selecting pick 230 forms an upper part of the second conveying path R2 together with the below mentioned lower sheet discharging guide plate 2108 as indicated by two-dots-and-a-dash line as shown in FIG. 7. Furthermore, a lower stream part of the second conveying path R2 is formed of the upper and lower sheet discharging guide plates 2108 and 2109.

Figure 8:
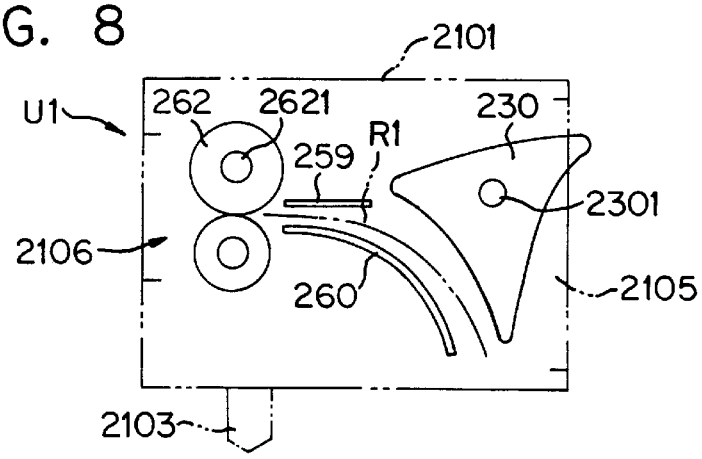
FIG. 8 shows the function of a first unit establishing a sheet discharging unit, as shown in FIG. 5.

A pair of sheet discharging rollers 262 is rotated by a drive gear 2126 of the main body which links together with a drive power source (not shown) of an image forming apparatus 221 as shown in FIGS. 8 and 13; this part forms the construction of a first drive transmission medium D1. The drive gear 2126 of the main body of this part is pivotably held at a side of the first unit U1, engaged with a drive gear 2622 which is unitarily formed with the drive roller (at the upper side thereof shown in FIG. 8) of the sheet discharging rollers pair, and the sheet discharging rollers pair 262 is rotated via the drive gear 2622 and the shaft 2621. An idle roller 2130 which is engaged with the drive gear 2622 is pivotably held at the rear end of the casing 2101 of the first unit U1, and the idle roller 2130 functions as a drive transmission medium to the second unit U2.

A pair of duplex conveying relay rollers 2119 of the second unit U2 is rotated by the second drive transmission medium D2 as shown in FIG. 13. Namely, a drive gear 2128 is unitarily connected at an end of a shaft 2127 of the drive roller (at the upper side thereof shown in FIG. 9) of a pair of the duplex conveying relay rollers 2119 shown in FIGS. 9 and 13. Furthermore, after connecting both of the casings 2101 and 2102 of the first unit U1 and second unit U2, a timing belt 2129 as a cog formed belt is passed between the drive gear 2128 at the side of the second unit U2 and a small gear of the idle roller 2130 at a side of the first unit U1; this part forms the construction of a second drive transmission medium D2.

A thus constructed second drive transmission medium D2, if drive force is transmitted to the large gear of the idle roller 2130 via the drive gear 2622 of the first unit U1, a pair of duplex conveying relay rollers 2119 is rotated via a small gear of the idle roller 2130, the timing belt 2129, the drive gear 2128, and the shaft 2127. The sheet P having one surface already copied is conveyed towards the duplex copying unit 280 at appropriate timing.

The side cover 2123 for relieving the conveying path R to remove a jammed sheet, if necessary, is held for movement to swing open and closed relative to the main body around a shaft pin 238 at the image forming unit 224 as shown in FIGS. 5 and 6. The side cover 2123 supports the transferring unit 234.

Here, under a selecting state of the duplex copying unit 280 from the side cover 2123, described later, if the side cover 2123 moves from the position indicated by two-dots-and-a-dash line in FIG. 6 to the position indicated by solid line, the conveying path R of the sheet P is relieved and the first and second conveying paths R1 and R2 after the fixing unit are also relieved.

The duplex copying unit 280 is located at an outside of the side cover 2123, and is held for movement that swings open and closed relative to the main body about a pin shaft 2131 and is mounted detachably to the main body. The duplex copying unit 280 has a switchback path 2135 for accepting the sheet P sent from the pair of duplex conveying relay rollers 2119, a reversing roller 2132 for reversing the sheet P passing through the path 2135 and a plurality of pairs of conveying rollers 2134 for conveying the reversed sheet P through a duplex path 2133 towards the registration rollers pair 257.

The scanner 227 is mounted on a rack 2136 and is composed of a contact glass 2137 for mounting an original document, illuminating lamp 2138 for irradiating the original document mounted on the contact glass, a scanning mirror 2139 for reflecting light from the surface of the original document, a pair of light path turning mirrors 2140 which moves at half the speed of the scanning mirror, a lens 2141, and a CCD 2142 as an opto-electric conversion element array.

Operation on the basis of the above-mentioned construction will be described below.

First, at a simplex sheet discharging mode of face-down discharging, the solenoid 2114 is held in a non-magnetized state. Selecting pick 230 is held in a position indicated by solid line in FIG. 7, and forms the first conveying path R1 together with the lower sheet discharging guide plate 260.

If the image forming apparatus starts a simplex copying operation, optical writing is executed on the surface of the photoconductive element 223 which is charged uniformly by the charging device, by the optical writing device 231 according to the image of an original document read by the scanner 227, or information on the image from a personal computer, and an electrostatic latent image is formed thereof. The electrostatic latent image on the photoconductive element 223 is formed as a visible image with toner by a developing roller 2331 in a developing device 233 after removing charge on non-image areas by an eraser (not shown).

On the other hand, the sheet P is fed by a feeding -roller 250 from one of the sheet feeding cassettes 249 of the sheet feeding part 225, is sent towards the conveying path R by the conveying roller 256 being separated individually one by one by a pair of the separating rollers, and sent towards the registration rollers pair 257. The registration roller pair 257 sends the sheet P towards the transferring unit 234 at a timing wherein the visible image on the photoconductive element 223 and the sheet P meet without displacement at a nipped position (contacting area) of the photoconductive element 223 and the transferring belt 245.

A predetermined voltage is applied to the bias roller 248 from a high voltage power source at a timing at which the sheet P is conveyed into the nipped position, charging the transferring belt, and toner on the photoconductive element 223 is transferred on the sheet P. The sheet P is separated from the photoconductive element 223 because of electrostatic attracting force of the transferring belt 245, conveyed on the transferring belt 245, separated from the transferring belt 245 at a position of the drive roller 245, and sent to the fixing unit 226. The sheet P is inserted between the fixing roller pair 251 and 252 heated to a predetermined temperature. The sheet P is guided towards the separating pick 253 and an exit guide plate 239 after being heat/fixed, further passing through the first conveying path R1, between the selecting pick 230 and the upper and lower sheet discharging guide plates 259 and 260, and discharged on the upper face part 228 in a face-down state by the sheet discharging rollers pair 262.

Furthermore, in the case of a sheet jamming at the conveying path R, R1 and R2, an operator pivots the duplex copying unit 280 about the pin 2131, and holds the unit 280 at the position indicated by solid line as shown in FIG. 6. The operator then moves the side cover 2123 to the position indicated by solid line as shown in FIG. 6, pivoting about the pin 238. Still further, the operator retrieves upper parts of both of the first and second units U1 and U2 by rotating the cover 241 covering an upper part of both of the units U1 and U2 about a pivotably supported pin (not shown). The exit guide plate 239 mounted on the side cover 2123 is moved with the side cover 2123 at the same time the cover 2123 is opened.

In such a manner as stated above, the conveying path R and the conveying paths R1 and R2 after the fixing unit 226 are accessed, jammed sheet removing space is secured, and a jammed sheet P is capable of being removed.

On the other hand, the solenoid 2114 is magnetized in the duplex copying mode. The selecting pick 230 is held at the second position indicated by two-dots-and-a-dash line as shown in FIG. 7, and forms the second conveying path R2 together with lower sheet discharging guide plate 2108.

If the image forming apparatus starts duplex copying operation, the sheet P in which the toner image is formed on one surface thereof is conveyed from the fixing unit 226 towards the first unit U1 as in simplex copying operation.

At this time, the sheet P is conveyed along the second conveying path R2 between the selecting pick 230 and the lower sheet discharging guide plate 2108, and conveyed to the switchback path 2135 in the duplex copying unit 280 by a pair of duplex conveying relay rollers 2119. In addition, the sheet P is switched back towards the duplex path 2133 from the switchback path 2135 in a reversed state by the reversing roller 2132, reaches the pair of registration rollers, and a copying operation for another side surface is executed continuously as in simplex copying. At this time, magnetization of the solenoid 2114 is released, and the first discharging path R1 is formed. The sheet P in which both side surfaces are finished being copied proceeds from the fixing unit 226 towards a sheet discharging rollers pair 262 via the first conveying path R1, and discharged towards the upper face part 228.

The image forming apparatus 221 is provided with the sheet discharging unit for discharging the sheet P copied on one surface thereof in a face-down state and for conveying the sheet P towards the duplex copying unit 280 as shown in FIG. 5. This construction realizes simplex and duplex copying operations selectably.

Figures 11A, 11B, 11C:
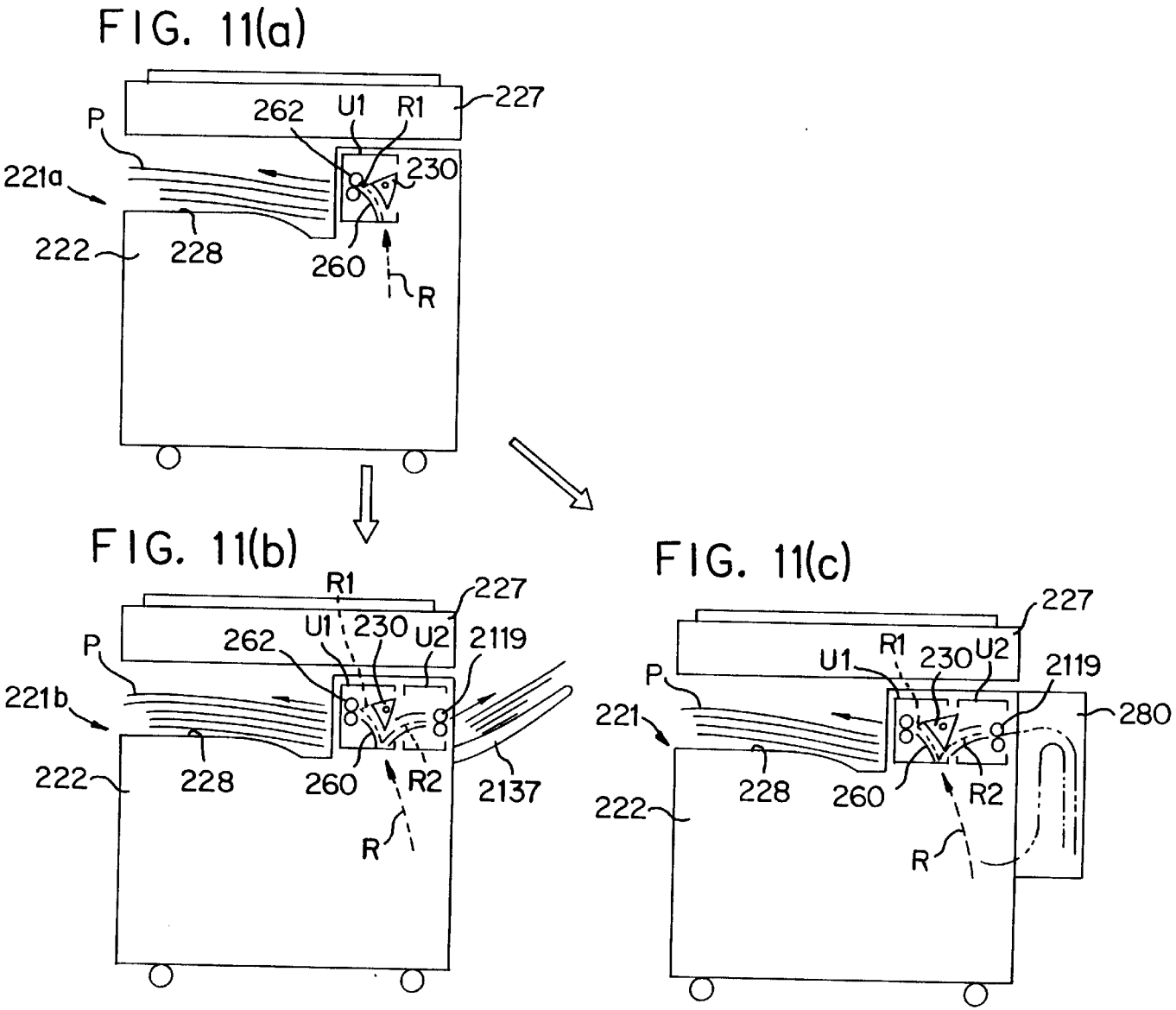
FIGS. 11(*a*)–11(*c*) are schematic illustrations showing an image forming apparatus as depicted in FIG. 5, wherein (a) depicts a simplex copying machine with face-down sheet discharging, (b) shows a simplex copying machine with both face-down and face-up sheet discharging, and (c) shows a duplex copying machine.

Instead of the above-mentioned construction, an image forming apparatus 221*a* is shown schematically in FIG. 11(*a*), wherein the sheet discharging unit provided with only the first unit U1 for simplex copying with face-down discharging without the duplex copying unit 280; the rest of the functions are the same as for the image forming apparatus 221 of FIG. 5.

The image forming apparatus 221*a* has the basic construction of the image forming apparatus 221 as shown in FIG. 5, and has the style of the simplex copying mode such as discharging the sheet towards the upper part 228 in a face-down state. The sheet discharging unit in this case is constructed of only the first unit U1 while eliminating the second unit U2. Therefore, the apparatus is simplified, manufacturing cost is reduced and occupation of useless space is avoided.

Furthermore, an image forming apparatus 221*b* as another construction of the apparatus is shown schematically in FIG. 11(*b*) which eliminates the duplex copying unit 280 from the image forming apparatus 221 as shown in FIG. 5, mounting a sheet discharging tray 2137 for face-up discharging instead. The rest of the functions are the same as for the image forming apparatus 221 of FIG. 5.

This image forming apparatus 221*b* can achieve both face-up and face-down sheet discharging. In this case, before starting a copying operation, the operator selects and instructs for face-down sheet discharging or face-up sheet discharging. On that basis, the selecting pick 230 is selected and held at the first position indicated by solid line or the second position indicated by two-dots-and-a-dash line, as shown in FIG. 7. Under the condition of selecting the selecting pick 230, and after executing only the simplex copying operation, the apparatus can discharge the copied sheet towards the upper part 228 through the first conveying path R1 in the face-down state, or towards a sheet discharging tray 2137 for face-up discharging by a face-up (FU) sheet discharging rollers pair 2119' (the name of the pair of duplex conveying relay rollers is changed in the image forming apparatus 221*b*) through the second conveying path R2.

In such manner, each of the image forming apparatus 221*a*, 221*b* and 221 as shown in FIGS. 11(*a*) to (*c*) is easily changed in sheet discharging mode. Particularly, because the sheet discharging unit 220 is separately composed of the first unit U1 and the second unit U2, when the image forming apparatus 221*a* is constructed as a face-down sheet discharging machine model using only the first unit U1, eliminating the useless second unit U2, manufacturing cost is reduced and occupying unnecessary space is avoided.

To the contrary, by constructing the image forming apparatus 221 and 221*b* which need the first unit U1 and the second unit U2, namely, by constructing the simplex copying machine model or the duplex copying machine model for both face-down and face-up sheet discharging, the operator can open the side cover 2123 about the shaft pin 238, and attach or detach the second unit U2 easily through the opening of the main body 222 as shown in FIG. 12.

Furthermore, in this case, the positioning pin 2124 of the second unit U2 is easily inserted into the positioning hole 2107 of the first unit U1, both units U1 and U2 are easily positioned relative to each other, and avoiding any displacement, the second unit U2 is conveniently and accurately assembled. Still further, the side cover 2123 is detachable from the main body 222 through the shaft pine 238, the duplex copying unit 280 is detachable from the main body through the shaft pin 2131, and the construction of the models are easily interchanged, as shown in FIGS. 6 and 12.

Third Embodiment

This third embodiment is explained in reference to FIGS. 15 through 19.

Figure 15:
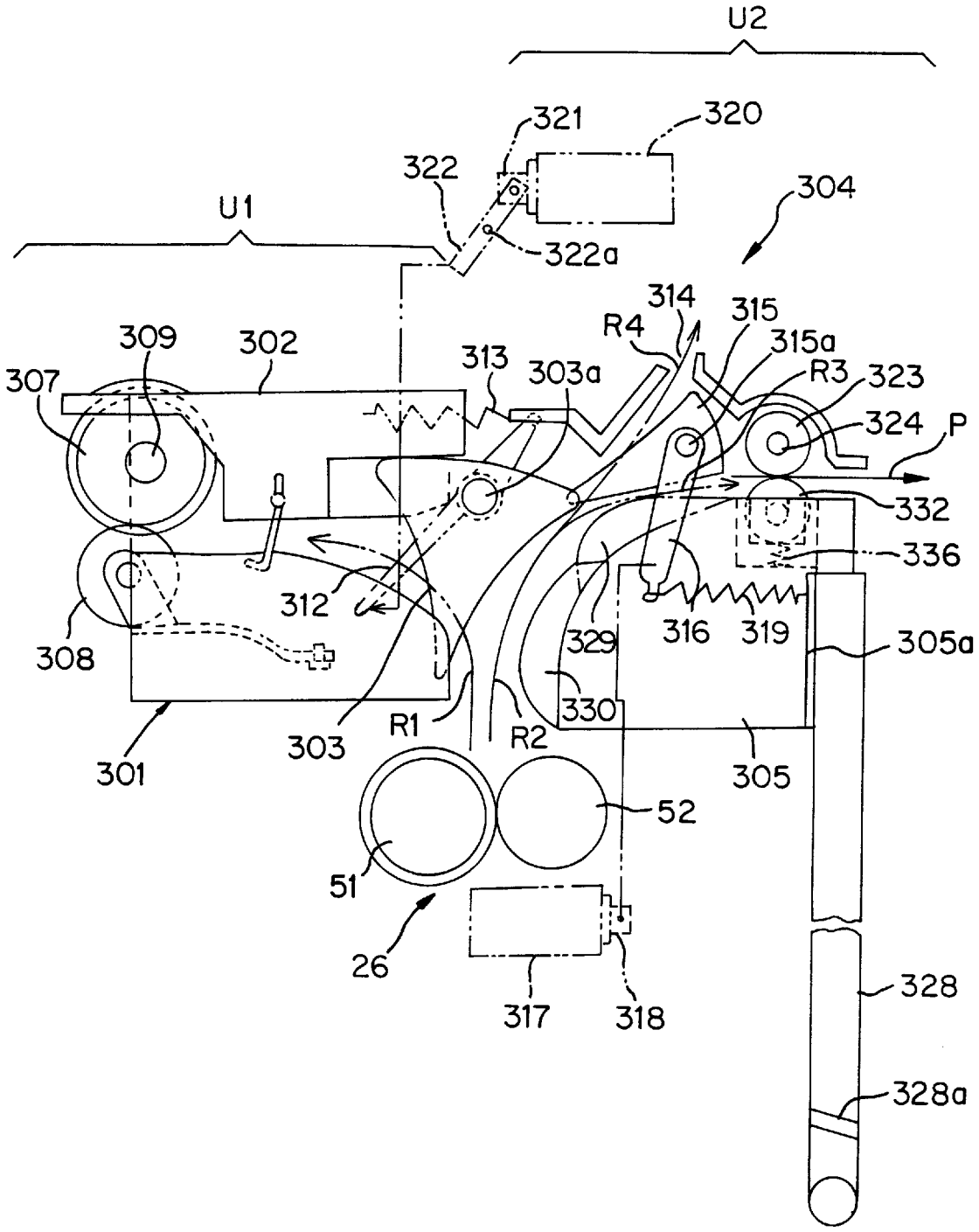
FIG. 15 shows the operation of the duplex copying machine implementing another embodiment of the invention.

The sheet discharging unit 300 explained in this embodiment is composed of the first unit U1 having a first conveying path R1, and the second unit U2 having a second conveying path R2, and wherein the second conveying path R2 is further composed of a third conveying path R3 for conveying the sheet P towards the duplex copying unit and a fourth conveying path R4 for discharging the sheet P towards a mail box or the like, as shown in FIG. 15.

Figure 16:
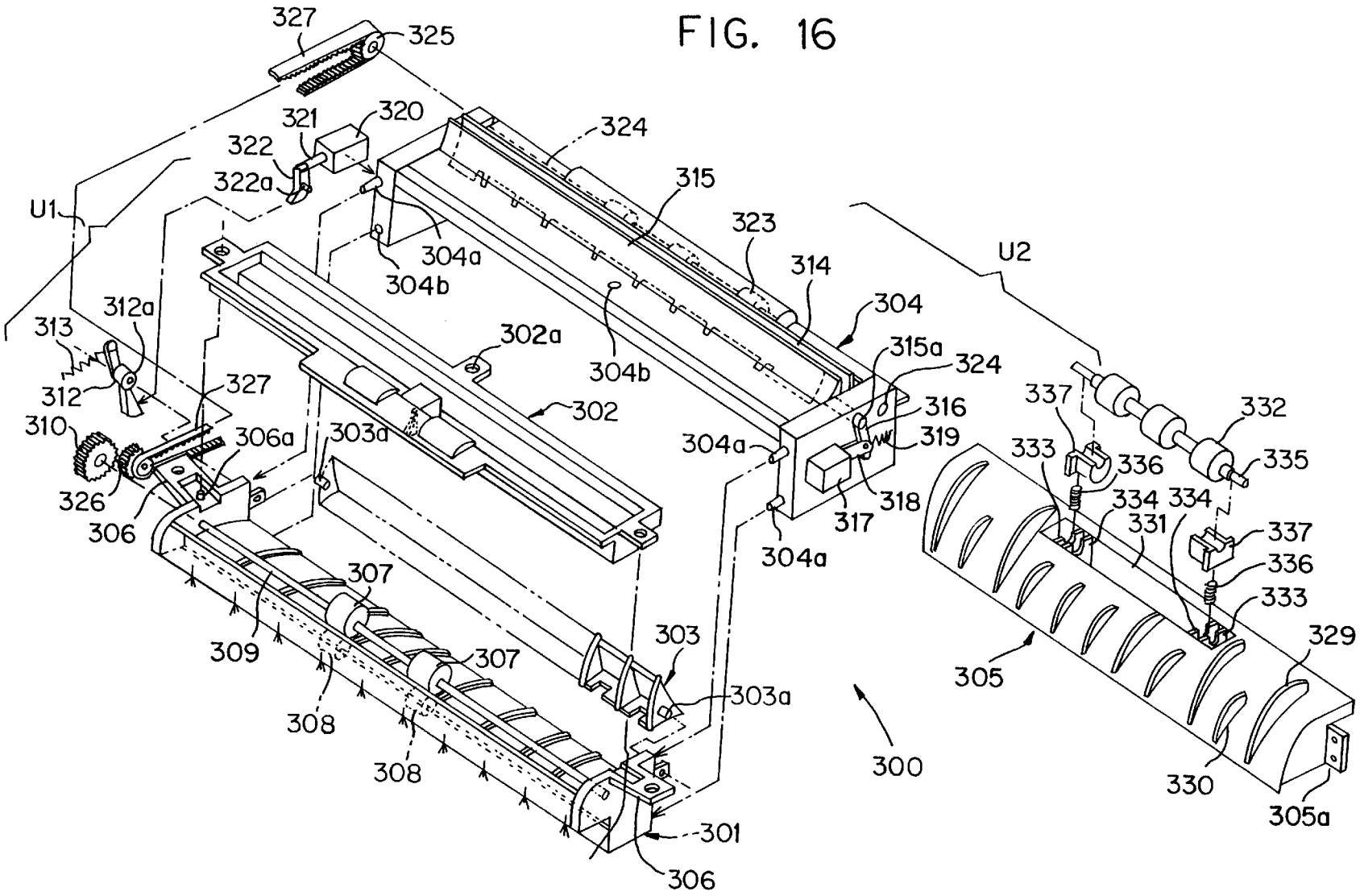
FIG. 16 is an exploded perspective view corresponding to FIG. 15.

Further explaining in detail, the first unit U1 is schematically constructed with a sheet discharging guide 301 which is fixed to the main body, a sheet discharging sensor plate 302 which is positioned/fixed at an upper face of the sheet discharging guide 301, and a first selecting pick 303 for selecting the sheet P towards the first conveying path R1 or the second conveying path R2. The selecting pick 303 is supported rotatably on the sheet discharging guide 301 as shown in FIG. 16.

On the other hand, the second unit U2 is schematically constructed with a detachable unit 304 mounted detachably on the sheet discharging guide 301 and mainly corresponds to duplex copying mode and an exit guide plate 305 which is commonly provided for duplex and simplex copying modes and is fixed to the side cover.

Parts which correspond to the upper and lower sheet discharging guide plates in the sheet discharging guide 301 are formed by mold shaping in a body, and are provided with fixing pieces 306 for fixing to the main body at both ends thereof. A projecting portion 306*a* for positioning the sheet discharging sensor plate 302 is formed on the fixing pieces 306. Furthermore, sheet discharging rollers 307 and 308 are provided on the sheet discharging guide 301. An inputting gear 310 in which power from a driving source of the main body (not shown) is inputted is fixed to an end (rear end) of a rotating shaft 309 of the upper sheet discharging roller 307.

A sheet discharging sensor 311 for detecting passage of the sheet P along the conveying path R1 is mounted on the sheet discharging sensor plate 302.

A first selecting pick 303 is formed in a triangular prism shape with a rib-like construction containing internal caves and is also formed of shafts 303*a* to be supported by the sheet discharging guide 301 at both ends thereof. An operation piece 312 for rotating the first selecting pick 303 is fixed to the shaft 303*a* of a rear end part of the guide 301. A spring 313 for returning the first selecting pick 303 to the position for guiding the sheet P towards the first conveying path R1, which is a usual predetermined position, is hooked between an upper end part of the operating piece 312 and a side plate of the sheet discharging guide 301. The operating piece 312 is held for rotation relative to the side plate by a shaft hole 312*a*.

An upward sheet discharging exit 314 for a mail box or the like, which is mounted on an upper part of the main body, is formed of the detachable unit 304. The second selecting pick 315 for selecting the third conveying path R3 or fourth conveying path R4 for the sheet P is held for rotation beneath the mail box. An arm 316 is fixed to a rotation shaft 315*a* at a front side of the second selecting pick 315, and the arm 316 is rotatably connected to a movable iron core 318 of a solenoid 317 as a second operating medium which is fixed to a side plate disposed at a front side of the detachable unit 304. A spring 319 for returning the second selecting pick 315 to a position for guiding the sheet P towards the fourth conveying path, as a usual predetermined position, is hooked between the lower end portion of the arm 316 and the side plate. A solenoid 320 as a first operating medium for the first selecting pick 303 is mounted on a side plate of a rear side of the detachable unit 304, and a pressing piece 322 which presses a lower end portion of the operating piece 312 fixed to the first selecting pick 303 is rotatably connected to the movable iron core 321 of the solenoid 320. The pressing piece 322 is held for rotation relative to a side plate by a shaft 322*a* which is formed in a body.

A relay roller 323, which is one part of the rollers pair for conveying the sheet P towards the duplex copying unit, is held for rotation relative to the detachable unit 304 from behind, and a drive gear 325 as a drive medium of the relay roller is fixed to a rear end portion of a rotation shaft 324. The drive gear 325 is connected to a relay gear 326 which engages the inputting gear 310 through a belt 327 held for rotation relative to a rear side of a side plate of the sheet discharging guide 301, and is held for rotation according to rotation of the inputting gear 310.

A projecting portion 304*a* for positioning the detachable unit 304 to the sheet discharging guide 301 and a screw hole 304*b* for fixing by a screw are formed at both sides of a front face of the detachable unit 304. Further, both members of the sheet discharging sensor plate 302 and the detachable unit 304 are fixed by a screw through a hole 302*a* formed on a back side of the plate 302 and a hole 304*b* formed on a front side of the detachable unit 304.

A fixing piece 305*a* for fixing the exit guide plate 305 to the side cover 328 is formed in a body with both ends of the exit guide plate 305 (shown in FIG. 15). On an external face, a plurality of two kinds of guide ribs 329 and 330 are formed with certain spacing in a longitudinal direction. Still further, a recess 331 is formed on the exit guide plate 305 (shown in FIG. 19). A driven relay roller 332 of another side of the pair of the relay rollers pair is held for rotation and is detachably contained. Supporting plates 333 and 334 for supporting a rotation shaft 335 of the relay roller 332 are fixed on both ends of the recess 331 respectively, and are supported under the force of a spring 336 which is contained between the supporting plates 333 and 334, and a bearing 337 which is supported by the one of the supporting plates 334.

Next, operation of above-mentioned construction is explained hereinafter.

In a case of duplex copying operation, the solenoid 320 for driving the first selecting pick 303, and the solenoid 317 for driving the first selecting pick 303, and the solenoid 317 for driving the second selecting pick 315 are turned on together. When the solenoid 320 is turned on, the operating piece 312 is pressed by pressing piece 322, and according to the operation as mentioned above, the first selecting pick 303 moves from the position which guides the sheet P towards the first conveying path R1 to the position which guides the sheet P towards the second conveying path R2, and remains positioned there as shown in FIG. 15. Further, when the solenoid 317 is turned on, the arm 316 rotates and according to this operation, the second selecting pick 315 moves from the position which guides the sheet P towards fourth conveying path R4 to the position which guides the sheet P towards the third conveying path R3, and remains as positioned there. As a result, the third conveying path R3 for duplex copying is formed and the sheet P from the fixing unit 26 is sent towards the duplex copying unit.

An accepting entrance 328*a* for accepting the sheet P which is discharged from the duplex copying unit towards the conveying path of the main body is formed in the side cover 328 as shown in FIG. 15. Further, the lower sheet discharging roller 308 is pressed against the upper sheet discharging roller 307 by a sheet spring 338.

Figure 17:
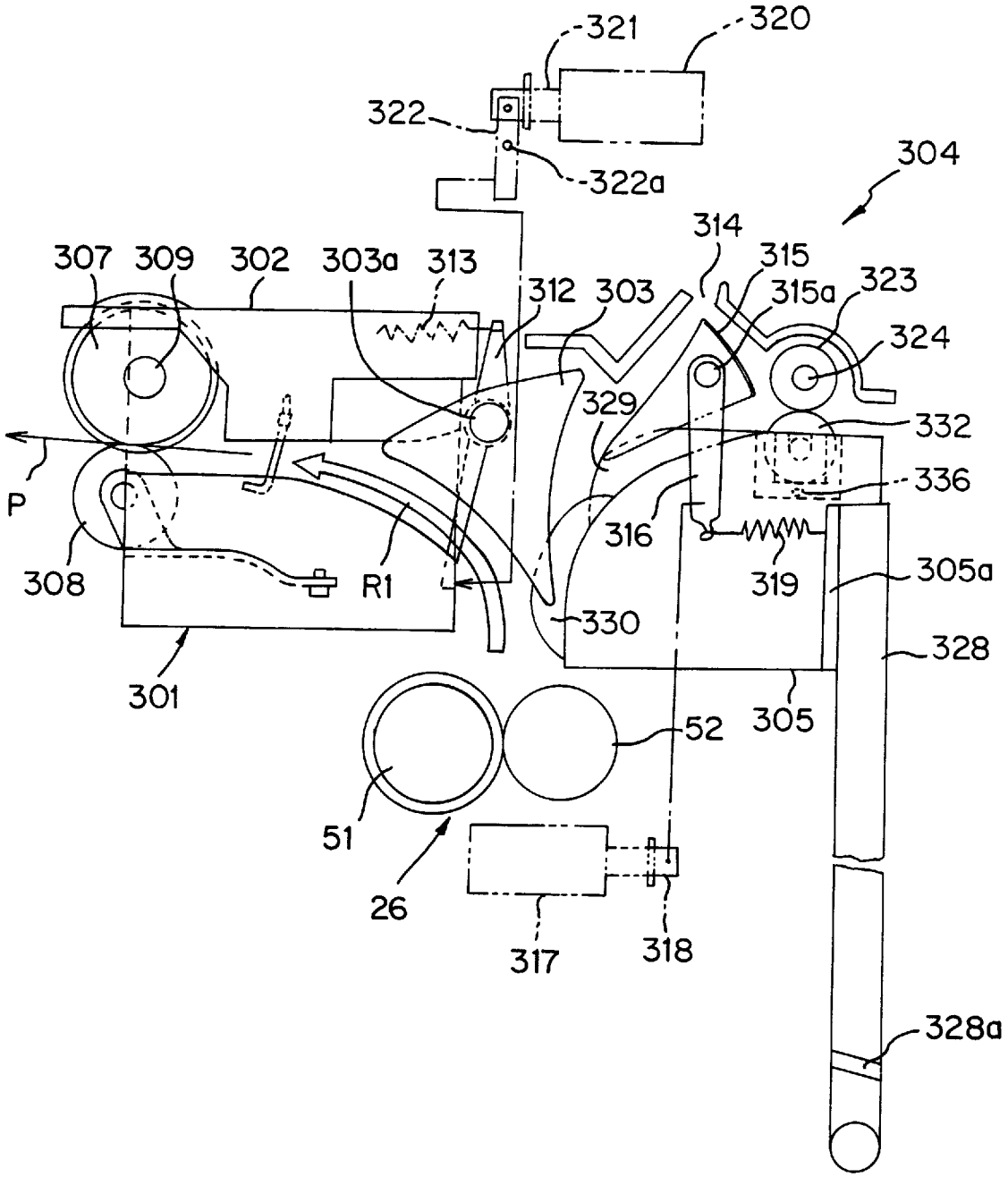
FIG. 17 shows the operation of the simplex machine corresponding to the example of FIG. 15.

According to a reversing operation of the sheet P at the duplex copying unit, the solenoid 320 and the solenoid 317 are turned off, as shown in FIG. 17. When the solenoid 320 is turned off, the first selecting pick 303 returns to the predetermined position (the position to guide the sheet P towards the first conveying path R1) by the force of the spring 313. As a result, the first conveying path R1 is formed and the sheet P, carrying a duplex copy, is discharged from the fixing unit 26 towards the upper face part as a face-down discharging tray.

Further, when the solenoid is turned off, the second selecting pick 315 is returned to the position which guides the sheet P towards the fourth conveying path R4 by the force of the spring 319. This operation considers that the continuous discharging of the sheet P towards the mail box etc. has high possibility, while the sheet P is not discharged continuously towards the duplex copying unit. Thus heating and expanding electric power are reduced. Still further, a small and inexpensive solenoid is used for solenoid 317, making the entire size of the sheet discharging unit small.

Further, the solenoid 320 having a larger duty rate than the solenoid 317 (the term "duty rate" means the duration of turn on time over an entire time) is mounted near a cooling fan in the main body, and therefore, heating and expanding electric power are suppressed. In view of such an aspect, the aforementioned construction contributes to small sizing of the sheet discharging unit.

Figure 18:
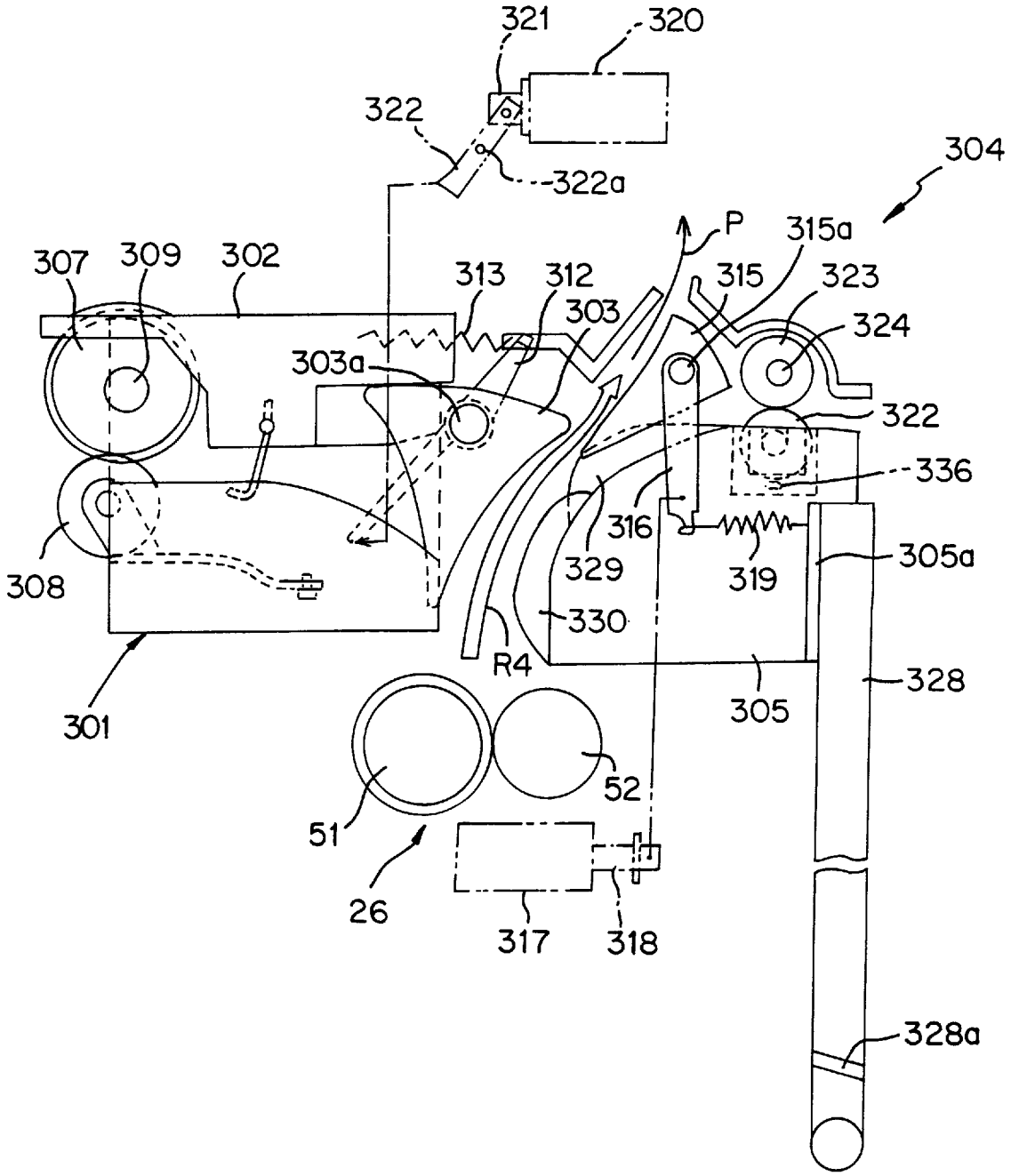
FIG. 18 shows the operation of the fourth conveying path as in the example of FIG. 15.

In case of discharging the sheet towards the mail box or the like, only the solenoid 320 is turned on, and the first selecting pick 303 is positioned to the second conveying path R2 as shown in FIG. 18. The second selecting pick 315 is positioned for guiding the sheet P to fourth conveying path R4, and the sheet P discharged from the fixing unit 26 is sent to the mail box or the like.

Figure 19:
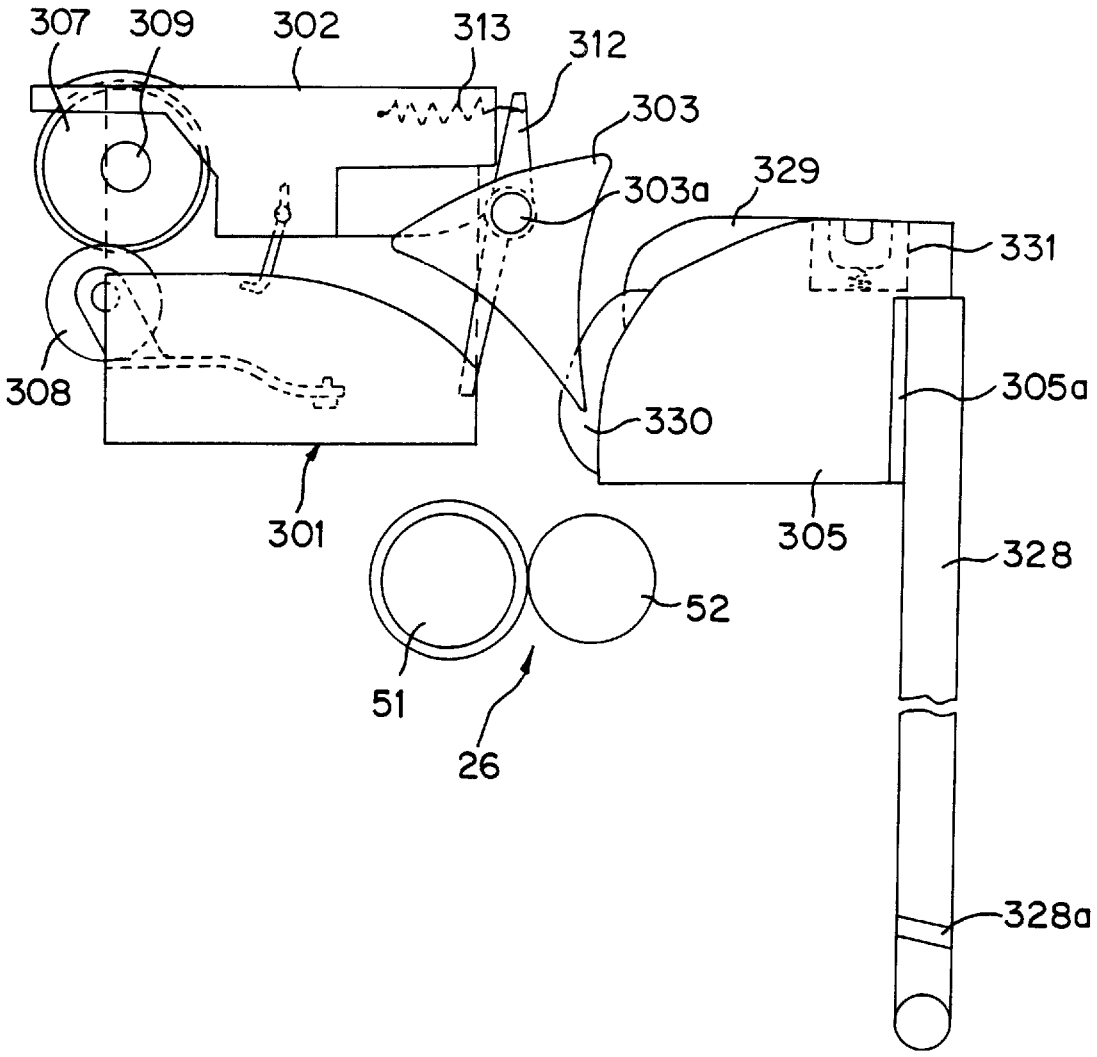
FIG. 19 illustrates dismantling of unnecessary parts of a simplex copying machine, in accord with the example of FIG. 15.

When the sheet discharging unit is used for simplex copying, the members used for only duplex copying, namely, the detachable unit 304 and the relay roller 332, are eliminated as shown in FIG. 19.

Although the present invention has been described with reference to particular means, materials and embodiments, from the foregoing description one skilled in the art can easily ascertain the essential characteristics of the present invention and various changes and modifications may be made to adapt the various uses and characteristics without departing from the spirit and scope of the present invention as described by the claims that follow.

We claim:

1. An image forming apparatus, comprising:

an image forming unit for forming a visible image on a sheet;

a sheet feeding unit upward connected to said image forming unit for feeding the sheet towards said image forming unit;

a sheet discharging section having a discharging tray located at an upper portion of said image forming unit for stacking the sheet;

a side cover on a main body of the apparatus, openable for exposing a conveying path of the sheet;

a duplex copying unit for reversing the sheet, the duplex copying unit being located outside of and releasable from the side cover; and a course selecting member for guiding the sheet selectably towards said discharging tray or said duplex copying unit, the visible image being formed on the sheet by said image forming unit as said sheet is conveyed approximately vertically by said sheet feeding unit to be discharged along a discharging path of said discharging section towards said discharging tray;

wherein said side cover is provided with a duplex copy exit guide plate for guiding the sheet discharged from said image forming unit towards said duplex copying unit, and said side cover is positioned on said main body such that said discharging path is exposed when said conveying path is exposed by opening said side cover while said duplex copying unit is released from said side cover;

further wherein said side cover has an opening for accepting the sheet which is conveyed from said duplex copying unit.

2. The apparatus of claim 1, including a pair of relay rollers for conveying the sheet from said sheet discharging section towards said duplex copying unit.

3. The apparatus of claim 1, wherein said side cover is pivotably mounted to said main body and is openable by pivoting to expose said discharging path.

4. The apparatus of claim 1, wherein said duplex copy exit guide plate is detachable from said side cover.

5. An image forming apparatus, comprising:

an image forming unit for forming a visible image on a sheet;

a sheet feeding unit upward connected to said image forming unit for feeding the sheet towards said image forming unit;

a sheet discharging section having a discharging tray located at an upper portion of said image forming unit for stacking the sheet;

a side cover for, when opened, exposing a sheet conveying path through which the sheet is conveyed approximately vertically by the sheet feeding unit, the sheet receives a visible image formed thereon by said image forming unit, and the sheet bearing the visible image is discharged towards said discharging tray;

a duplex copying unit for reversing the sheet, detachably mounted on a main body of the apparatus outside said side cover; and a simplex copy exit guide plate for guiding the sheet discharged by said image forming unit only towards said discharging tray, and a duplex copy exit guide plate for guiding the sheet discharged by said image forming unit only towards said duplex copying unit, each said plate being mountable exchangeably and detachably at said side cover;

wherein when said duplex copying unit is not mounted, said simplex copy exit guide plate is provided on said side cover, and said side cover, when opened to expose said conveying path, also exposes said sheet discharging path, and when said duplex copying unit is mounted, a course selecting member is mounted on a sheet discharging guide plate for selectably guiding the sheet from said image forming unit towards said discharging tray or said duplex copying unit, and a duplex copy exit guide plate is provided on said side cover, and said side cover when opened, while said duplex copying unit is separated from said side cover to expose said sheet conveying path, also exposes a sheet discharging path of said sheet discharging section.

6. An apparatus according to claim 5, including a pair of relay rollers for conveying the sheet from said sheet discharging section towards said duplex copying unit.

7. An image forming apparatus, comprising:

an image forming unit for forming a visible image on a sheet;

a sheet feeding unit upward connected to said image forming unit for feeding the sheet towards said image forming unit;

a sheet discharging section having a discharging tray located at an upper portion of said image forming unit for stacking the sheet;

a side cover on a main body of the apparatus, openable for exposing a conveying path of the sheet;

a duplex copying unit for reversing the sheet, the duplex copying unit being located outside of and releasable from the side cover; and a course selecting member for guiding the sheet selectable towards said discharging tray or said duplex copying unit, the visible image being formed on the sheet by said image forming unit as said sheet is conveyed approximately vertically by said sheet feeding unit to be discharged along a discharging path of said discharging section towards said discharging tray;

wherein said side cover is provided with a duplex copy exit guide plate for guiding the sheet discharged from said image forming unit towards said duplex copying unit, and said side cover is positioned on said main body such that said discharging path is exposed when said conveying path is exposed by opening said side cover while said duplex copying unit is released from said side cover;

wherein said sheet discharging section comprises upper and lower discharging guide plates for guiding the sheet from said image forming unit towards said discharging tray, and a discharging frame which supports said lower discharging guide plate, wherein said lower discharging guide plate and said discharging frame are constructed in a first common body, and said upper discharging guide plate and an external cover of said main body are constructed in a second common body.

8. The apparatus of claim 7, including a pair of relay rollers for conveying the sheet from said sheet discharging section towards said duplex copying unit.

9. The apparatus of claim 7, wherein said side cover is pivotably mounted to said main body and is openable by pivoting to expose said discharging path.

10. The apparatus of claim 7, wherein said duplex copy exit guide plate is detachable from said side cover.

11. An image forming apparatus comprising:

an image forming unit for forming a visible image on a sheet;

a sheet feeding unit for feeding the sheet from a source of sheets to said image forming unit wherein the image is formed on the sheet, located beneath said image forming unit;

a sheet discharging section having a sheet discharging unit and a discharging tray for stacking the sheet, the section located in an upper part of said image forming unit;

a side cover for exposing a sheet conveying path, along which path includes forming an image on the sheet by said image forming unit, while conveying the sheet approximately vertically by said sheet feeding unit, and discharging the sheet with the image towards said discharging tray;

a duplex copying unit for reversing the sheet, detachably mounted to a main body of the apparatus and located outside of said side cover;

a discharging guide plate for guiding the sheet from said image forming unit towards said discharging tray and an exit guide plate for guiding the sheet towards said duplex copying unit, and a course selecting member on said sheet discharging unit for guiding the sheet from said image forming unit selectably towards said discharging tray or said duplex copying unit; and a course selecting member driving device for driving said course selecting member to select the sheet, the driving device being mounted detachably on said sheet discharging unit, and when said course selecting member driving device is detached from said sheet discharging unit, said course selecting member is in a state to guide the sheet towards said discharging tray.

12. An image forming apparatus according to claim 11, including a relay roller for conveying the sheet from said image forming unit towards said duplex copying unit, and a relay roller driving device for driving said relay roller mounted detachably on said main body.

13. An image forming apparatus according to claim 12, wherein said course selecting member driving device, said relay roller, and said relay roller driving device are detachably arranged together in a common body.

14. An image forming apparatus according to claim 11, wherein said side cover has an opening for accepting the sheet which is conveyed from said duplex copying unit.

15. An image forming apparatus, comprising:

an image forming unit for forming a visible image on a sheet;

a sheet feeding unit upward connected to said image forming unit for feeding the sheet towards said image forming unit;

a sheet discharging unit having a discharging tray located at an upper portion of said image forming unit for stacking sheets;

a duplex copying unit for reversing the sheet;

a first discharging path for discharging the sheet towards said discharging tray; and a second discharging path for discharging the sheet towards a third discharging path or said duplex copying unit, the sheet from said image forming unit being selectably conveyed towards said first discharging path or said second discharging path;

wherein said sheet discharging unit comprises a first unit which establishes said first discharging path and a second unit which establishes said second discharging path.

16. An image forming apparatus according to claim 15, wherein said first unit comprises:

a first discharging roller;

a first guide plate which forms a first discharging path; and said course selecting member for selectably guiding the sheet towards first or second discharging path, and wherein said second unit comprises:

a second discharging roller;

a conveying roller for conveying the sheet towards said duplex copying unit;

driving means for driving said second discharging roller or said conveying roller;

a second guide plate for establishing said second discharging path; and a driving means for driving said course selecting member which selectably guides the sheet towards said first or second discharging path.

17. An image forming apparatus according to claim 15, wherein said first unit is positioned in the main body and said second unit is positioned against said first unit.

18. An image forming apparatus according to claim 15, wherein said second unit is detachable through said side cover when opened.

19. An image forming apparatus, comprising:

an image forming unit for forming a visible image on a sheet;

a sheet feeding unit upward connected to said image forming unit for feeding the sheet towards said image forming unit;

a sheet discharging unit having a discharging tray located at an upper portion of said image forming unit for stacking sheets;

a duplex copying unit for reversing the sheet;

a first discharging path for discharging the sheet towards said discharging tray; and a second discharging path for discharging the sheet towards another discharging tray or said duplex copying unit, the sheet from said image forming unit being selectably conveyed towards said first discharging path or said second discharging path;

wherein said sheet discharging unit comprises a first unit which establishes said first discharging path and a second unit which establishes said second discharging path;

further wherein said second discharging path includes a third discharging path for discharging the sheet towards said another discharging tray and a fourth discharging path for conveying the sheet towards said duplex copying unit, wherein said first unit includes a first discharging roller, a first guide plate which establishes said first discharging path, and a first course selecting member which selectably guides the sheet towards said first or second discharging path, and said second unit includes first operating means for operating said first course selecting member so as to guide the sheet selectably towards said first or second discharging path, a third guide plate which establishes said third discharging path, a fourth guide plate which establishes said fourth discharging path, a second course selecting member for selectably guiding the sheet towards third or fourth discharging path, and second operating means for operating said second course selecting member so as to guide the sheet selectably towards said third or fourth discharging path.

20. An image forming apparatus according to claim 19, wherein said second operating means is a solenoid and when said solenoid is turned off, said second course selecting member guides the sheet towards said third discharging path, and when said solenoid is turned on, said second course selecting member guides the sheet towards said fourth discharging path.

21. An image forming apparatus according to claim 19, wherein said first unit comprises:

a first discharging roller;

a first guide plate which forms a first discharging path; and said course selecting member or selectably guiding the sheet towards first of second discharging path, and wherein said second unit comprises:

a second discharging roller;

a conveying roller for conveying the sheet towards said duplex copying unit;

driving means for driving said second discharging roller or said conveying roller;

a second guide plate for establishing said second discharging path; and a driving means for driving said course selecting member which selectably guides the sheet towards said first or second discharging path.

22. An image forming apparatus according to claim 19, wherein said first unit is positioned in the main body and said second unit is positioned against said first unit.

23. An image forming apparatus according to claim 19, wherein said second unit is detachable through said side cover when opened.

* * * * *